US010838358B2

(12) United States Patent
Ishida et al.

(10) Patent No.: US 10,838,358 B2
(45) Date of Patent: Nov. 17, 2020

(54) IMAGE FORMING APPARATUS THAT HAS SHEET SENSOR

(71) Applicant: CANON KABUSHIKI KAISHA, Tokyo (JP)

(72) Inventors: Tsutomu Ishida, Suntou-gun (JP); Tomonari Inoue, Eagle, ID (US); Kenji Abe, Mishima (JP); Takashi Kuwata, Suntou-gun (JP); Keita Nakajima, Mishima (JP); Ko Katahira, Suntou-gun (JP); Takehito Osada, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/181,880

(22) Filed: Nov. 6, 2018

(65) Prior Publication Data

US 2019/0137930 A1 May 9, 2019

(30) Foreign Application Priority Data

Nov. 7, 2017 (JP) ..... 2017-215023
Apr. 26, 2018 (JP) ..... 2018-085722
Oct. 25, 2018 (JP) ..... 2018-201162

(51) Int. Cl.
*G03G 21/20* (2006.01)
*G03G 15/20* (2006.01)
*G03G 15/00* (2006.01)

(52) U.S. Cl.
CPC ..... *G03G 21/206* (2013.01); *G03G 15/2017* (2013.01); *G03G 15/70* (2013.01); *G03G 15/6576* (2013.01); *G03G 2215/00548* (2013.01); *G03G 2215/00611* (2013.01); *G03G 2215/00616* (2013.01)

(58) Field of Classification Search
CPC ..... G03G 21/206; G03G 15/2017; G03G 15/6576; G03G 2221/1645; G03G 15/70; G03G 2215/00333; G03G 2215/00548; G03G 2215/00611; G03G 2215/00616
See application file for complete search history.

(56) References Cited

U.S. PATENT DOCUMENTS 7,018,121 B2 * 3/2006 Barry ..... B41J 11/009 250/239
2018/0118488 A1 * 5/2018 Suzuki ..... B65H 7/14
2018/0203402 A1 * 7/2018 Okuma ..... G03G 15/70
(Continued)

FOREIGN PATENT DOCUMENTS

JP 63-178654 A 7/1988
JP 04-15433 B2 3/1992
JP 11059976 A * 3/1999
(Continued)

*Primary Examiner* — Walter L Lindsay, Jr.
*Assistant Examiner* — Laura Roth
(74) *Attorney, Agent, or Firm* — Venable LLP

(57) ABSTRACT

An image forming apparatus comprises a light-emission unit, a reflecting member, a light-receiving unit, a detection unit, a ventilation unit configured to send air to the reflecting member, and a control unit. The control unit adjusts at least one of an operation duration and an airflow rate of the ventilation unit, in accordance with a detection signal outputted by the light-receiving unit when a sheet is not at a position where light crosses a conveyance path.

20 Claims, 22 Drawing Sheets

(56) References Cited

U.S. PATENT DOCUMENTS

2019/0233233 A1* 8/2019 Suzuki ..... B65H 3/66

FOREIGN PATENT DOCUMENTS

| | | | | | |
|---|---|---|---|---|---|
| JP | 2000-052069 | A | | 2/2000 | |
| JP | 2000-231295 | A | | 8/2000 | |
| JP | 2002-281201 | A | | 9/2002 | |
| JP | 2007033520 | A | * | 2/2007 | ..... G03G 15/6573 |

* cited by examiner

IMAGE FORMING APPARATUS THAT HAS SHEET SENSOR

BACKGROUND OF THE INVENTION

Field of the Invention

The present invention relates to an image forming apparatus.

Description of the Related Art

A fixing apparatus fixes a toner image onto a sheet by applying heat and pressure to the toner image. A sheet sensor is employed to detect a sheet jam that occurs in or near the fixing apparatus. According to Japanese Patent Publication No. 04-15433, a sheet sensor that detects the existence or absence of a sheet in accordance with whether light is blocked by a sheet has been proposed.

When a sheet passes through a fixing apparatus, there are cases where moisture included in the sheet evaporates, and water vapor occurs. There are cases where this water vapor affects the detection accuracy of the sheet sensor. The sheet sensor recited in Japanese Patent Publication No. 04-15433 employs a configuration in which a reflecting member reflects light emitted by a light-emission unit, and a light-receiving unit receives the reflected light. Accordingly, when the reflecting member suffers dew condensation due to the water vapor generated from the sheet and the reflectance of the reflecting member decreases, the sheet detection accuracy will decrease. In addition, water vapor generated from the sheet may also become waterdrops and adhere to a conveyance guide member arranged in the vicinity of the fixing apparatus. When a waterdrop adheres to a conveyed sheet, an image defect can occur.

SUMMARY OF THE INVENTION

The present invention provides an image forming apparatus comprising: a light-emission unit configured to emit light; a reflecting member that reflects the light emitted from the light-emission unit; a light-receiving unit configured to receive the light reflected from the reflecting member, the light crossing a conveyance path, on which a sheet is conveyed, one or more times from the light-emission unit until reaching the light-receiving unit; a detection unit configured to detect, based on a detection signal that the light-receiving unit outputs in accordance with an amount of light received, whether a sheet is at a position where light crosses the conveyance path; a ventilation unit configured to send air to the reflecting member; and a control unit configured to adjust at least one of an operation duration and an airflow rate of the ventilation unit, in accordance with the detection signal outputted by the light-receiving unit when a sheet is not at the position where light crosses the conveyance path.

Further features of the present invention will become apparent from the following description of exemplary embodiments with reference to the attached drawings.

DESCRIPTION OF THE EMBODIMENTS

First Embodiment

With reference to the drawings, description is given for an electrophotographic color laser beam printer as an example of an image forming apparatus. However, the dimensions, material, shape, relative arrangement, and the like of constituent components recited in this embodiment are not intended to limit the scope of this invention thereto, as long as there is no specific recitation in particular. In addition, an image forming apparatus according to the present invention is not limited to only a color laser beam printer, and may be another image forming apparatus such as a copying machine or a facsimile machine.

<Image Forming Apparatus>

Figure 1:
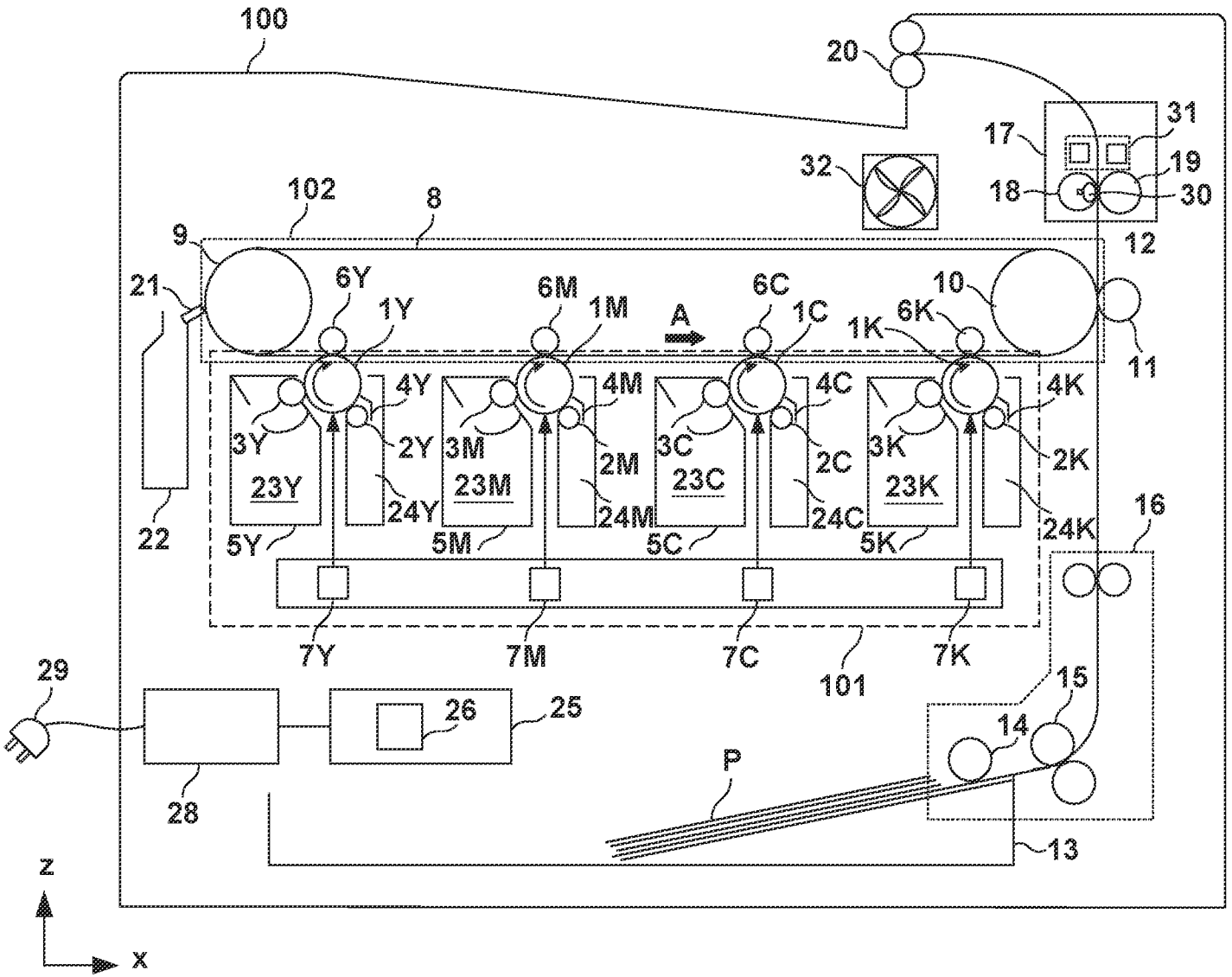
FIG. 1 is an overview cross-sectional view of an image forming apparatus.

An image forming apparatus 100 illustrated in FIG. 1 is provided with process cartridges 5Y, 5M, 5C, and 5K that can be attached to and detached from the main body. Note that the letters Y, M, C, and K added to reference numerals indicate yellow, magenta, cyan, and black toner colors, and these are omitted when matter common to each color is described. A process cartridge 5 has a toner container 23, a photosensitive drum 1, a charging roller 2, a development roller 3, a cleaning member 4, and a waste-toner container 24. In addition, the process cartridge 5 and an exposure device 7 form an image forming unit 101.

The toner container 23 contains a developing agent (written as toner below). The photosensitive drum 1 is an image carrier that carries an electrostatic latent image or a toner image. The charging roller 2 uniformly charges the surface of the photosensitive drum 1. The exposure device 7 outputs laser light in accordance with image information, and forms an electrostatic latent image on the surface of the photosensitive drum 1. The development roller 3 forms a toner image by performing development by causing toner supplied from the toner container 23 to adhere to the electrostatic latent image.

An intermediate transfer unit 102, which is an example of a transfer unit, has an intermediate transfer belt 8, a driving roller 9, an opposing roller 10, and a primary-transfer roller 6. The primary-transfer roller 6 is arranged facing the photosensitive drum 1, and primary-transfers the toner image carried on the photosensitive drum 1 to the intermediate transfer belt 8. The intermediate transfer belt 8 is stretched between the driving roller 9 and the opposing roller 10, and is driven by the driving roller 9 to rotate. The intermediate transfer belt 8 rotates in a direction indicated by an arrow symbol A, and conveys the toner image to a secondary-transfer section. The secondary-transfer section is formed by the intermediate transfer belt 8 and a secondary-transfer roller 11.

A feed cassette 13 contains a plurality of sheets P. A sheet P is a printing medium (a printing material) configured by a material that reflects or absorbs light by its surface and through which light does not transmit, as with paper. A feed roller 14 picks up a sheet P and feeds it to a conveyance path. Conveyance rollers 15 further convey the sheet P handed over from the feed roller 14 to a downstream side of the conveyance direction. Registration rollers 16 are conveyance rollers for synchronizing a timing when a sheet P reaches the secondary-transfer section to the timing when a toner image reaches the secondary-transfer section. The toner image is secondary-transferred to the sheet P at the secondary-transfer section. A belt cleaner 21 removes remaining toner on the intermediate transfer belt 8, and collects it into a waste-toner container 22.

The sheet P to which the toner image has been transferred is conveyed to a fixing apparatus 17. The fixing apparatus 17 has a heating roller 18 and a pressure roller 19 that apply heat and pressure with respect to the toner image and the sheet P. A heat generation unit such as a heater 30 is provided inside the heating roller 18. In addition, a temperature sensor 12 for measuring the temperature of the heater 30 or the heating roller 18 is provided on the heater 30. Discharge rollers 20 discharge the sheet P to which the toner image has been fixed to outside of the image forming apparatus 100.

A sheet sensor 31 is provided inside the fixing apparatus 17, downstream from the heating roller 18 and the pressure roller 19. Downstream means downstream in the conveyance direction of the sheet P. The sheet sensor 31 is a reflective type optical sensor. The sheet sensor 31 detects a sheet P conveyed by the heating roller 18 and the pressure roller 19.

A ventilation unit 32 has a fan that blows out or sucks air, and a motor for driving the fan. The ventilation unit 32 is provided outside of the fixing apparatus 17. The ventilation unit 32 cools the sheet sensor 31 by supplying air via a ventilation duct inside the fixing apparatus 17, for example.

A control board 25 has an electrical circuit for controlling each unit of the image forming apparatus 100. For example, a CPU 26 for controlling each unit of the image forming apparatus 100 by executing a control program is incorporated in the control board 25. The CPU 26 may be responsible for control relating to the sheet sensor 31 or a driving source (not illustrated) relating to conveyance of a sheet P, control of the ventilation unit 32, control of a driving source (not illustrated) for the process cartridge 5, control relating to image formation, control relating to fault detection, or the like. A switching power supply 28 converts an alternating power supply voltage inputted from a power supply cable 29 which is connected to an external power supply to a direct-current voltage, and supplies it to the control board 25 or the like.

<Sheet Sensor>

Figure 2A:
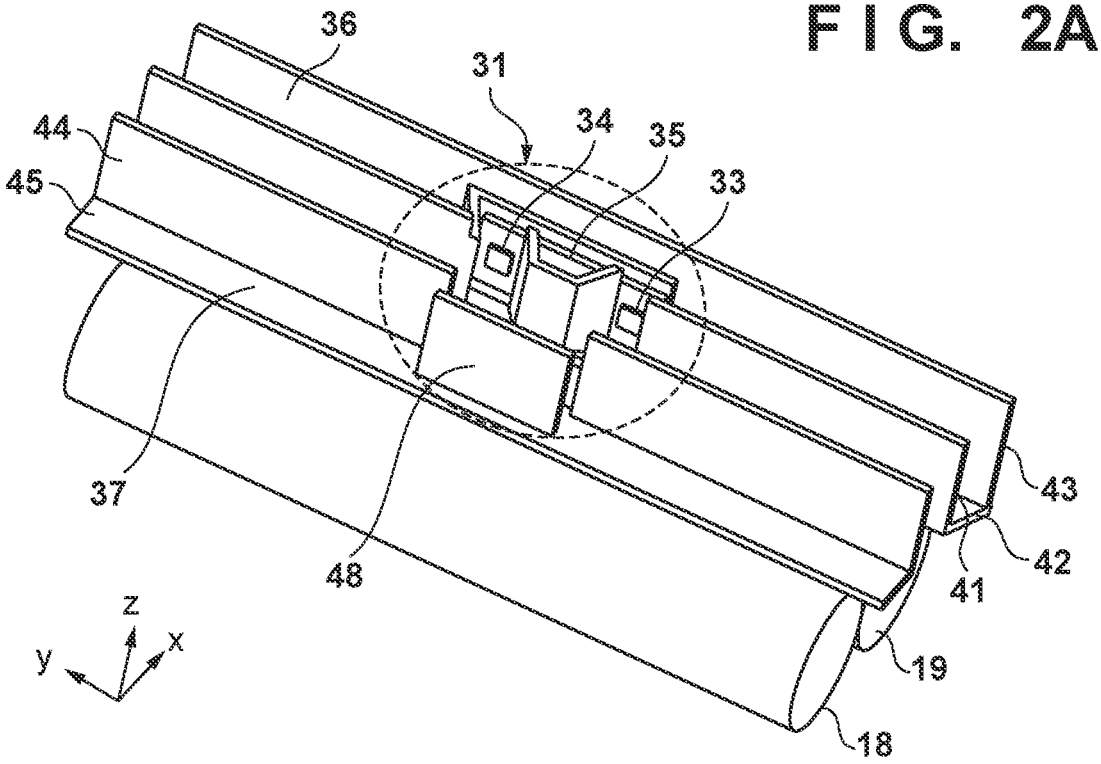
FIGS. 2A and 2B are perspective views of a sheet sensor.
Figure 2B:
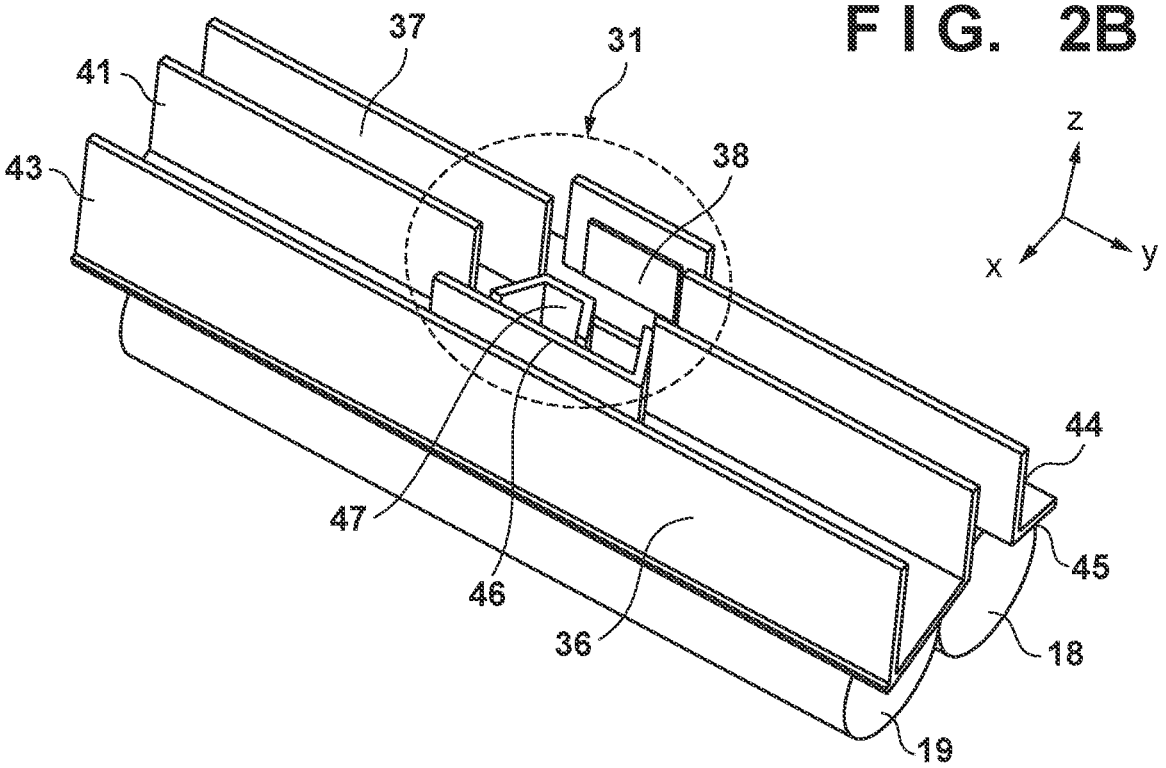

FIG. 2A and FIG. 2B are perspective views of the sheet sensor 31. FIG. 2A and FIG. 2B differ in viewpoints with respect to the sheet sensor 31. Note that, to make the orientation of the sheet sensor 31 easier to understand, arrow symbols x, y, and z that indicate directions have been added. An arrow symbol z indicates a height direction of the image forming apparatus 100, and is parallel with the conveyance direction of a sheet P in the fixing apparatus 17.

A first guide 36 is arranged above the pressure roller 19, and is a guide member for guiding a sheet P. A cross section of the first guide 36 that is parallel to the zx plane is substantially U-shaped. Specifically, one end of a first member 41 is joined to one end of a second member 42. In addition, the other end of the second member 42 and one end of a third member 43 are joined. The first member 41 has a guide surface for guiding a sheet P.

A second guide 37 is a guide member for guiding a sheet P, and is provided above the heating roller 18 and facing the first guide 36. A cross section of the second guide 37 that is parallel with the zx plane is substantially L-shaped. Specifically, one end of a fourth member 44 is joined to one end of a fifth member 45. The fourth member 44 has a guide surface for guiding a sheet P, and is parallel with the first member 41.

A cutout is provided in the center of the first member 41 of the first guide 36. A substrate 35 is fixed to a substrate holding member 46 that protrudes upward from the second member 42. A light emission unit 33 and a light-receiving unit 34 are installed in the substrate 35. A light-shielding member 47 that protrudes upward from the second member 42 is provided between the light emission unit 33 and the light-receiving unit 34.

A cutout is provided in the center of the fourth member 44 of the second guide 37. A reflecting member 38 is fixed to a reflecting member holding portion 48 that protrudes upward from the fifth member 45. In this example, the reflecting member holding portion 48 and the substrate holding member 46 are parallel to each other. In addition, the light emission unit 33, the reflecting member 38, and the light-receiving unit 34 are positioned so that light outputted from the light emission unit 33 is specularly reflected by the reflecting member 38, and the reflected light is incident on the light-receiving unit 34. Note that the reflecting member 38 may be a member that has a property of reflecting light, or may have a reflecting film. For example, a mirror, a metal or a resin that has glossiness, or the like can be employed as the reflecting member 38.

Figure 3A:
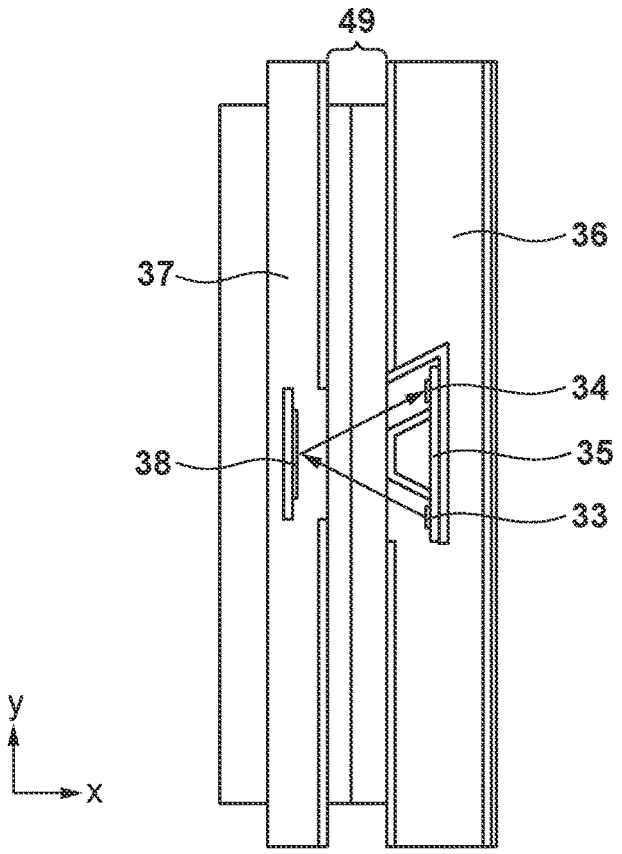
FIGS. 3A and 3B are plan views of the sheet sensor.
Figure 3B:
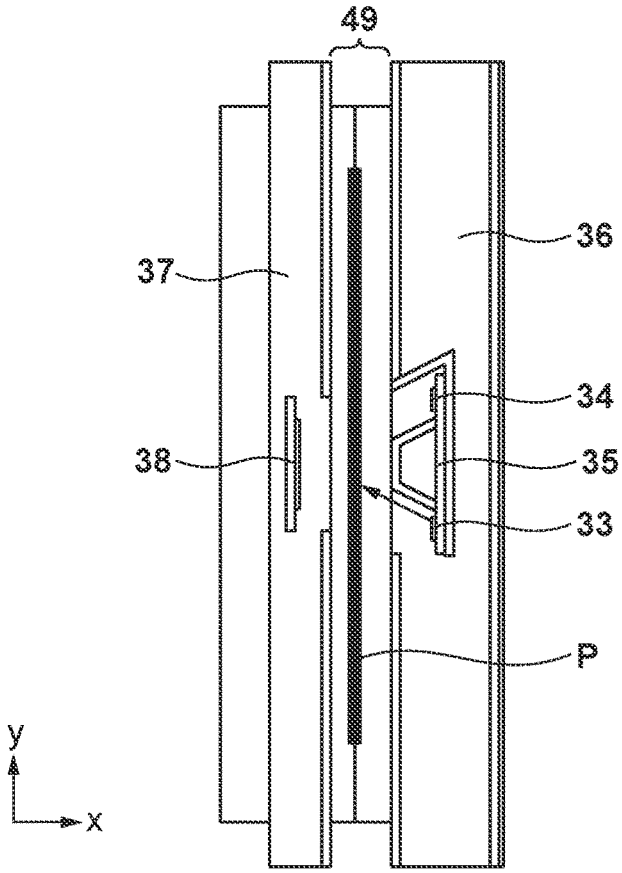

FIG. 3A is a plan view of the sheet sensor 31 when a sheet P is not passing through. FIG. 3B is a plan view of the sheet sensor 31 when a sheet P is passing through. As illustrated by FIG. 3A, light emitted by the light emission unit 33 crosses a conveyance path 49 and arrives at the reflecting member 38 of the second guide 37. The emitted light is reflected by the surface of the reflecting member 38, crosses the conveyance path 49, and arrives at the light-receiving unit 34. By this, the light-receiving unit 34 outputs a detection signal (for example, a low-level signal) that indicates that a sheet P is not detected. Alternatively, the light-receiving unit 34 does not output a detection signal (for example, a high-level signal) that indicates that a sheet P is detected. In this way, the sheet sensor 31 detects whether there is a sheet P at the position where light originating at the light emission unit 33 crosses in the conveyance path 49.

As illustrated by FIG. 3B, when a sheet P is being conveyed on the conveyance path 49, light from the light emission unit 33 arrives at the surface of the sheet P, but this light is light-shielded by the surface of the sheet P. In other words, light does not arrive at the reflecting member 38, and the light-receiving unit 34 is not able to receive the light reflected from the reflecting member 38. Accordingly, the light-receiving unit 34 outputs a detection signal (for example, a high-level signal) that indicates that a sheet P is detected. Alternatively, the light-receiving unit 34 does not output a detection signal (for example, a low-level signal) that indicates that a sheet P is not detected.

<Ventilation Unit>

Figure 4:
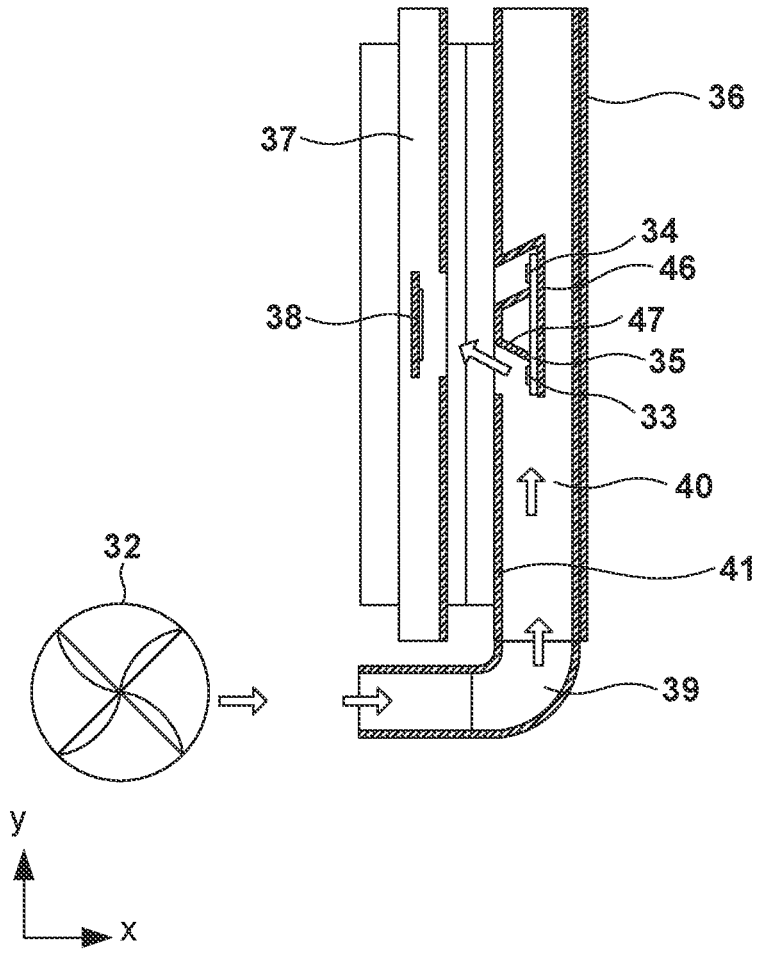
FIG. 4 is a cross-sectional diagram that illustrates a ventilation duct for the sheet sensor.

FIG. 4 is a cross-sectional diagram of a cooling mechanism for the sheet sensor 31. Arrow symbols in FIG. 4 indicate the flow of air. An evacuation guide 39 guides air blown out of the ventilation unit 32 to the first guide 36. The evacuation guide 39 and the first guide 36 form a ventilation duct 40. As illustrated by FIG. 4, the substrate 35 is arranged inside the ventilation duct 40. In addition, a space for air that entered from the evacuation guide 39 to pass through is provided between the first member 41 of the first guide 36 and the light emission unit 33. The light emission unit 33 is cooled by air that passes through this space. Furthermore, air that passes through this space is guided to the reflecting member 38 by a wall configured by part of the light-shielding member 47 whose cross-sectional shape forms a trapezoid. By the reflecting member 38 being ventilated with air, it is less likely for paper scraps or the like adhere to the reflective surface of the reflecting member 38. In addition, by low-moisture air being ventilated, water vapor near the reflecting member 38 is diffused, and it becomes easier to reduce dew condensation. In this way, by guiding air from the ventilation unit 32 arranged outside of the fixing apparatus 17 to the light emission unit 33, it is possible to cool the light emission unit 33 and clean the reflecting member 38 by ventilated air.

Note that the substrate 35 may be sandwiched by the substrate holding member 46 and the light-shielding member 47. By this, it is possible to stably position the substrate 35. In addition, while the light-shielding member 47 can also be used as a member for guiding air, it can additionally be used as a member for holding the substrate 35.

<Circuit Description>

Figure 5A:
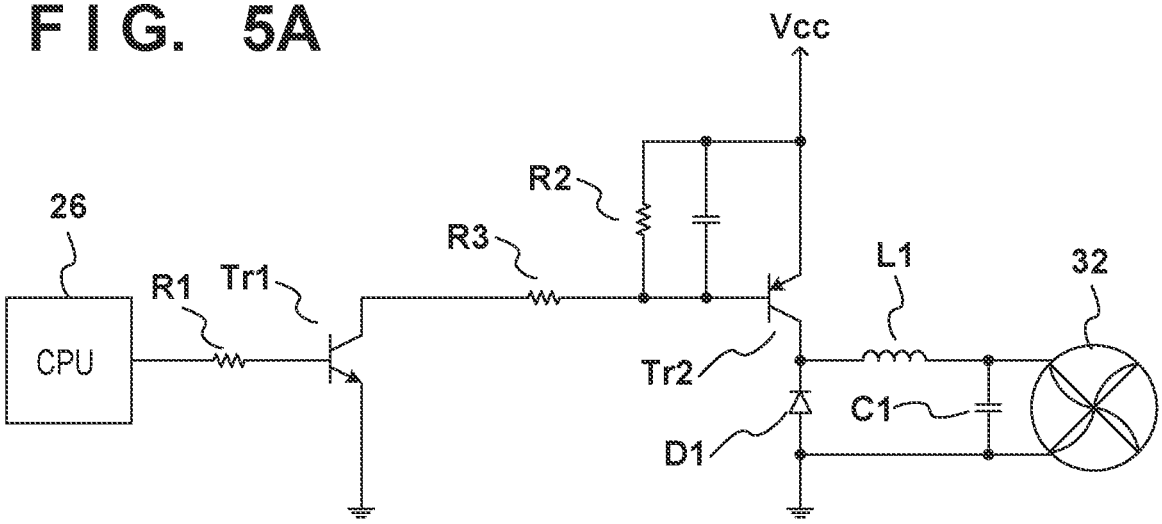
FIG. 5A is a view that illustrates a driving circuit for a ventilation unit.

FIG. 5A illustrates a driving circuit 57 of the ventilation unit 32. The driving circuit 57 is a buck converter. The CPU 26 outputs a PWM signal for driving the ventilation unit 32. The PWM signal is inputted to the base of a transistor Tr1 via a limiting resistor R1. When the PWM signal becomes a high level, the transistor Tr1 turns on. When the transistor Tr1 turns on, a voltage generated by dividing a reference voltage Vcc by resistors R2 and R3 is applied to the base of a transistor Tr2, and the transistor Tr2 turns on. When the transistor Tr2 turns on, a charge current flows from the reference voltage Vcc to an electrolyte capacitor C1 via the transistor Tr2 and a coil L1. When the PWM signal becomes a low level, the transistor Tr1 turns off, and accordingly the transistor Tr2 also turns off. By this, current flows in a route for the coil L1, the electrolyte capacitor C1 and a flyback diode D1. By the PWM signal repeatedly turning on and off, a voltage in accordance with the on duty of the PWM signal is generated at both ends of the electrolyte capacitor C1. This voltage is lower than the reference voltage Vcc. This voltage is applied to the motor of the ventilation unit 32, and thus the motor rotates. The rotational speed of the motor is decided in accordance with the voltage applied to the motor.

The CPU 26 changes the on duty of the PWM signal to change the voltage supplied to the ventilation unit 32. For example, the CPU 26 outputs a PWM signal of a first duty to thereby set the airflow rate of the ventilation unit 32 to a first airflow rate. Alternatively, the CPU 26 outputs a PWM signal of a second duty to thereby set the airflow rate of the ventilation unit 32 to a second airflow rate. If the second duty is larger than the first duty, the second airflow rate is larger than the first airflow rate.

Figure 5B:
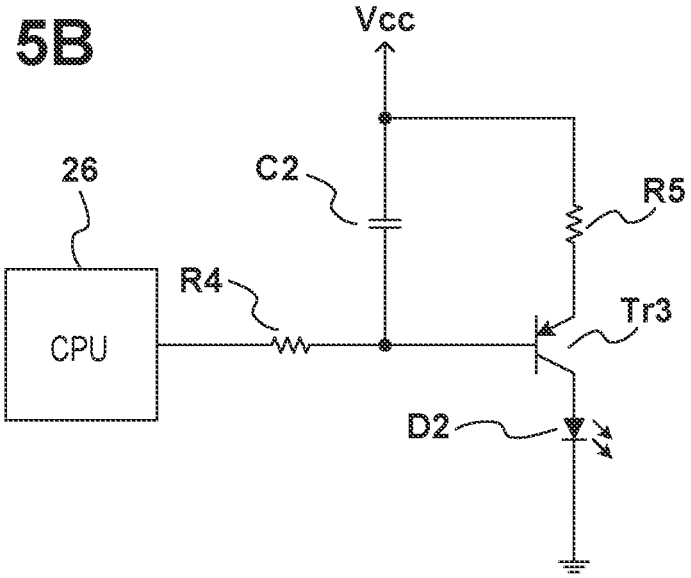
FIG. 5B is a view that illustrates a driving circuit for a light-emission unit.

FIG. 5B illustrates a driving circuit 56 of the light emission unit 33. The CPU 26 outputs a driving signal for driving the light emission unit 33. A driving signal outputted from the CPU 26 is smoothed by a smoothing circuit configured by a resistor R4 and a capacitor C2, and is inputted to the base of a transistor Tr3. By this the transistor Tr3 turns on. A limiting resistor R5 for limiting current is provided between the collector of the transistor Tr3 and the reference voltage Vcc. A light emitting diode D2 configures the light emission unit 33. The CPU 26 turns the driving signal on and off to switch emission/non-emission by the light emission unit 33.

Figure 5C:
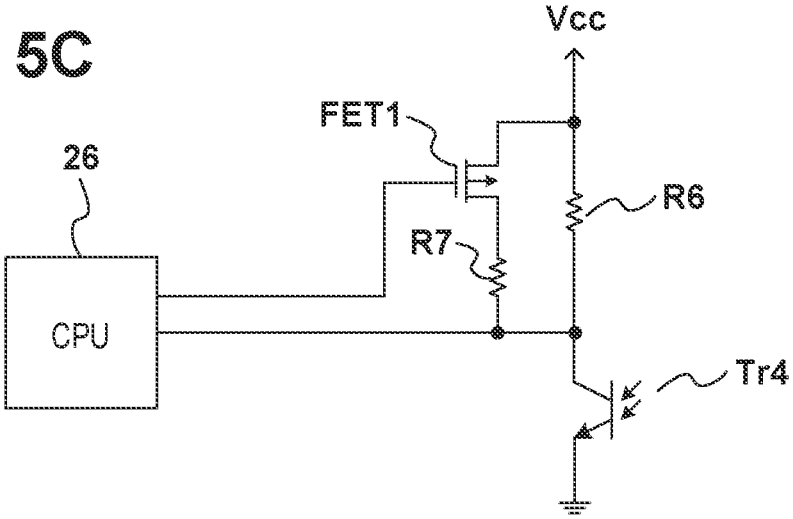
FIG. 5C is a view that illustrates a detection circuit for a light-receiving unit.

FIG. 5C illustrates a detection circuit for the light-receiving unit 34. The collector side of a phototransistor Tr4 for receiving light emitted from the light emission unit 33 is connected to the reference voltage Vcc via a pull-up resistor R6, and is also connected to an input port of the CPU 26. The phototransistor Tr4 outputs a detection signal (a voltage) of a level in accordance with an amount of light received. Accordingly, the voltage inputted to the input port of the CPU 26 changes between approximately 0V and Vcc. Here, the voltage applied to the input port of the CPU 26 is referred to as the amount of light received. The input port may be an AD port so that the CPU 26 can receive an analog value. When enough light to enable the phototransistor Tr4 to turn on is received, a voltage of approximately 0V is inputted to the input port of the CPU 26. In contrast, when the phototransistor Tr4 is not able to receive the light reflected from the reflecting member 38, a voltage that is approximately equal to the reference voltage Vcc is inputted to the input port. In other words, in this detection circuit, when the amount of light received increases the input voltage (detected voltage) decreases, and when the amount of light received decreases the input voltage increases. In such a case, if there is a sheet P the input voltage increases, and if there is no sheet P the input voltage decreases. Alternatively, a detection circuit may be employed such that the input voltage increases when the amount of light received increases, and the input voltage decreases when the amount of light received decreases. In such a case, if there is a sheet P, the input voltage increases, and if there is no sheet P the input voltage decreases.

The CPU 26 detects the existence or absence of a sheet P based on the voltage inputted from the input port. For example, configuration may be taken such that the CPU 26 determines that there is no sheet if the input voltage is less than or equal to a sheet threshold value, and the CPU 26 determines that there is a sheet if the input voltage exceeds the sheet threshold value. A resistor R7 is provided for switching the value for light-reception gain of the light-receiving unit 34. The CPU 26 outputs 0V as an on signal to the gate of an FET 1 to thereby turn the FET 1 on. By this the FET 1 enters a conductive state. In contrast, the CPU 26 outputs Vcc as an off signal to the gate of an FET 1 to thereby turn the FET 1 off. When the FET 1 is turned on, the collector side of the phototransistor Tr4 is connected to the reference voltage Vcc via a combined resistor of the pull-up resistor R6 and the resistor R7. When the FET 1 is turned off, the collector side of the phototransistor Tr4 is connected to the reference voltage Vcc via only the pull-up resistor R6. In other words, the CPU 26 outputs an on signal or an off signal to the gate of the FET 1 to thereby switch the value of the light-reception gain of the light-receiving unit 34. The CPU 26 outputs the on signal to thereby set the light-reception gain to a first gain, and outputs the off signal to thereby set the light-reception gain to a second gain. For example, a resistor of 180 kΩ may be employed as the pull-up resistor R6 and the resistor R7. In such a case, when the CPU 26 outputs the on signal in order to set the light-reception gain to the first gain, a resistance value connected to the reference voltage Vcc will be 90 kΩ. In contrast, when the CPU 26 outputs the off signal for setting the light-reception gain to the second gain, the resistance value will be 180 kΩ. In other words, the second gain is twice the first gain. By the CPU 26 outputting the off signal, the resistance value connected to the reference voltage Vcc increases. In other words, in comparison to the first gain, the second gain can decrease the voltage inputted to the CPU 26 sufficiently by a smaller amount of light received.

<Dew Condensation Detection>

When the reflecting member 38 suffers dew condensation, its reflectance decreases, the amount of light received at the light-receiving unit 34 decreases, and accuracy of detecting a sheet P decreases. When the sheet P passes through the fixing apparatus 17, moisture that had adhered to the sheet P evaporates and water vapor occurs. This water vapor can condensate on the reflecting member 38. Accordingly, by the ventilation unit 32 sending air to the reflecting member 38, it is possible to reduce water vapor present on and around the reflecting member 38. In the present embodiment, the CPU 26 detects an amount of light received by the light-receiving unit 34 when a sheet P is not in the sheet sensor 31. Here, it is assumed that the light-receiving unit 34 outputs a voltage that is inversely proportional (a negative correlation) with the amount of light received. When the inputted voltage exceeds a threshold value that is defined in advance, the CPU 26 determines that the amount of light received has decreased (that dew condensation has occurred). When the input voltage does not exceed the threshold value, the CPU 26 determines that the amount of light received is greater than or equal to a certain amount. In other words, the CPU 26 may determine that dew condensation of the reflecting member 38 has not occurred or determine that water vapor around the reflecting member 38 has not occurred.

<Ventilation Control>

Figure 6:
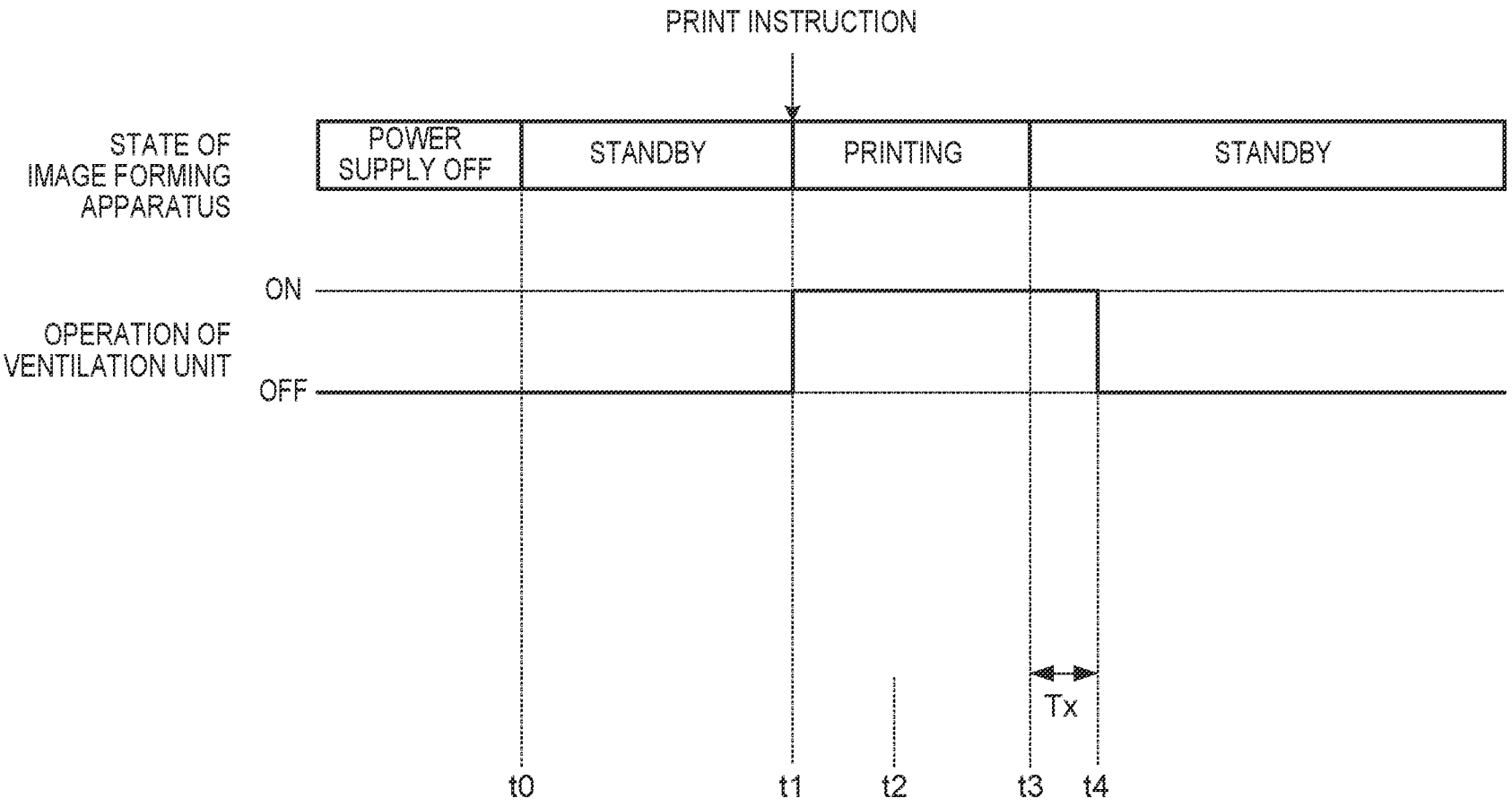
FIG. 6 is a timing chart that illustrates ventilation control.
Figure 7:
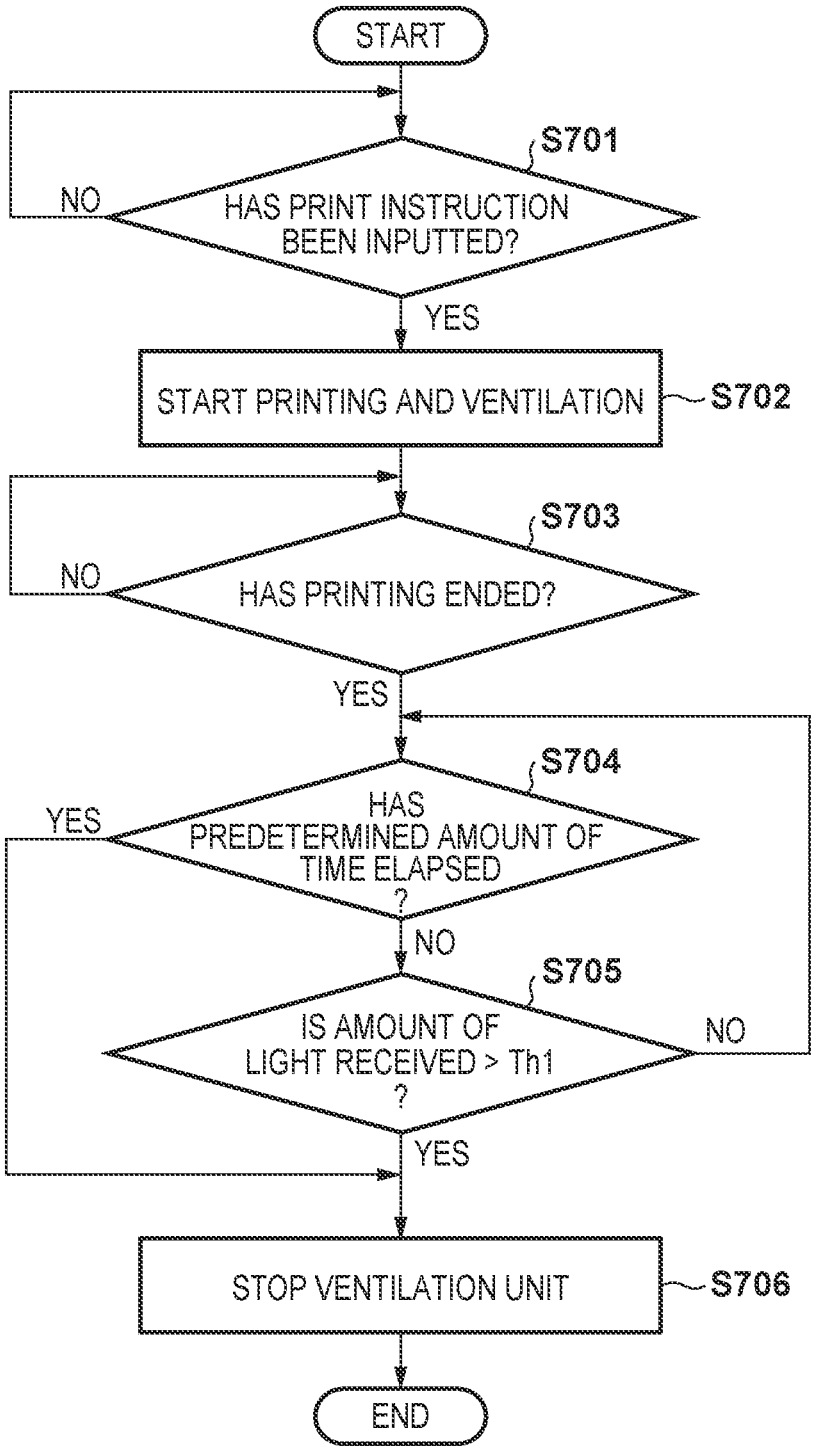
FIG. 7 is a flowchart that illustrates ventilation control.

FIG. 6 is a timing chart that illustrates states of the image forming apparatus 100, and operation of the ventilation unit 32. As illustrated by FIG. 6, at a time t0, power is supplied from a power supply, and the image forming apparatus 100 activates. In other words, at the time t0 the image forming apparatus 100 transitions from a powered off state to a standby state. FIG. 7 is a flowchart for illustrating control that is executed by the CPU 26.

In step S701, the CPU 26 determines whether a print instruction (an image forming instruction) has been inputted from an operation unit or an external computer. According to FIG. 7, a print instruction is inputted at a time t1. Note that, from the time t0 to the time t1, the state of the image forming apparatus 100 is the standby state for awaiting a print instruction. The ventilation unit 32 does not operate in the standby state which is immediately after the image forming apparatus 100 activates (airflow rate=0). Note that the CPU 26 may drive the ventilation unit 32 so that there is a very low airflow rate. When the print instruction is inputted at the time t1, the CPU 26 advances to step S702 in order to start image formation.

In step S702, the CPU 26 controls the image forming apparatus 100 to start printing. Furthermore, the CPU 26 drives the ventilation unit 32 to start ventilating the reflecting member 38. By this, cooling of the light emission unit 33 is also started, and a decrease in the amount of light emitted that accompanies a temperature rise of the light emission unit 33 is suppressed. The CPU 26 starts output of a PWM signal for driving the ventilation unit 32. By this, the driving circuit 57 supplies power to the motor of the ventilation unit 32, the motor rotates the fan, and ventilation of the light emission unit 33 or the reflecting member 38 is started.

In step S703, the CPU 26 determines whether printing has ended. The CPU 26 determines whether a print job designated by the operation unit or the like has entirely completed. When printing ends at a time t3, the CPU 26 proceeds to step S704.

In step S704, the CPU 26 determines whether an elapsed amount of time from the end of printing (the time t3) has become a predetermined amount of time Tx. The CPU 26 uses a timer or a counter to measure the elapsed amount of time since the end of printing. According to FIG. 6, the elapsed amount of time becomes the predetermined amount of time Tx at a time t4. The predetermined amount of time Tx is the amount of time needed until dew condensation of the reflecting member 38 is substantially resolved, and is set in advance. When the elapsed amount of time becomes the predetermined amount of time Tx, the CPU 26 advances the processing to step S706. When the elapsed amount of time has not reached the predetermined amount of time, the processing proceeds to step S705.

In step S705, the CPU 26 determines whether the amount of light received at the light-receiving unit 34 exceeds a dew condensation threshold value. Note that, when the light-receiving unit 34 generates an input voltage that is inversely proportional to the amount of light received, it is determined whether the input voltage is less than or equal to a voltage threshold. In other words, the CPU 26 may determine the state of the vicinity of the reflecting member 38 or whether the reflecting member 38 has dew condensation based on a voltage in accordance with the amount of light received at the light-receiving unit 34. Th1 is a dew condensation threshold value that is used to determine whether there is dew condensation. Thp is a sheet threshold value for determining the existence or absence of a sheet P. Here, Th1>Thp. If the amount of light received exceeds the dew condensation threshold value Th1, the CPU 26 determines that water vapor has sufficiently decreased, and that dew condensation has not occurred. If dew condensation has not occurred, the CPU 26 advances the processing to step S706 in order to stop the ventilation unit 32. Meanwhile, if the amount of light received does not exceed the dew condensation threshold value Th1 (if the input voltage is greater than or equal to the voltage threshold), the CPU 26 determines that it is possible for dew condensation to have occurred. In such a case, the CPU 26 advances the processing to step S704 while keeping the airflow rate of the ventilation unit 32 unchanged. Note that, when transitioning from step S705 to step S704, the CPU 26 may wait for a predetermined wait period. By this, the processing load on the CPU 26 is reduced.

In step S706, the CPU 26 stops the ventilation unit 32. For example, the ventilation unit 32 stops output of the PWM signal, or reduces the duty ratio of the PWM signal. Note that the ventilation unit 32 does not need to completely stop.

For example, the duty ratio of the PWM signal may be changed so that the airflow rate of the ventilation unit 32 becomes very low.

By virtue of this embodiment, the CPU 26, by detecting the amount of light received, can obtain the state of dew condensation of the reflecting member 38, and a level to which water vapor in the vicinity of the reflecting member 38 has occurred. For example, in a case where consideration is not given for an occurrence level for water vapor or dew condensation, the ventilation unit 32 would ordinarily be forcibly driven for a certain amount of time. However, in the present embodiment, if it is estimated that the occurrence level of water vapor or dew condensation is low, the CPU 26 stops the ventilation unit 32. By this, the operation duration of the ventilation unit 32 is reduced, and power consumption is also reduced. In addition, because the operation duration of the ventilation unit 32 is reduced, the CPU 26 can promptly transition from a print state to a subsequent state (the standby state or the like). The dew condensation threshold value Th1 is set larger than the sheet threshold value Thp. Accordingly, the CPU 26 can reliably detect a state where a sheet P is not present. Specifically, in addition to allowing for a reduction in power consumption and shortening of the operation duration of the ventilation unit 32, sheet detection accuracy improves.

Note that, in the present embodiment, description was given of an example of a sequence for changing the operation duration of the ventilation unit 32 after printing, in accordance with the amount of light received. Instead of changing the operation duration of the ventilation unit 32, the CPU 26 may change the airflow rate of the ventilation unit 32 in accordance with the amount of light received. For example, the CPU 26 may change the duty ratio of the PWM signal in accordance with the amount of light received. When the image forming apparatus 100 activates at the time t0, the ventilation unit 32 is driven so as to have the first airflow rate (which may be zero). In addition, at the time t1, the ventilation unit 32 is driven so that its airflow rate becomes the second airflow rate (the second airflow rate>the first airflow rate). From the time t3 to the time t4, the ventilation unit 32 continues to perform ventilation at the second airflow rate. At the time t4, the airflow rate of the ventilation unit 32 is reduced from the second airflow rate to the first airflow rate (which may be zero). Note that the CPU 26 may control the airflow rate of the ventilation unit 32 to be zero from the time t0 until the time t1, control the airflow rate to be the first airflow rate (>0) from the time t1 until the time t2, and control the airflow rate to be the second airflow rate (>the first airflow rate) from the time t2. Here, the time t2 is a time between the time t1 and the time t3 in FIG. 6.

In the present embodiment, description is given for a configuration for controlling one ventilation unit 32 by one condition, as a configuration of the image forming apparatus 100. One ventilation unit 32 may be controlled by a plurality of conditions. For example, the operation duration of the ventilation unit 32 may be controlled in accordance with the amount of light received by the light-receiving unit 34, and the temperature inside the fixing apparatus 17. In such a case, control based on the amount of light received may be prioritized, and control based on the temperature inside the fixing apparatus 17 may be prioritized. In the control based on the temperature inside the fixing apparatus 17, the temperature detected by the temperature sensor 12 is used. For example, even if the amount of light received exceeds the dew condensation threshold value Th1, the CPU 26 may continue operation of the ventilation unit 32 if the temperature inside the fixing apparatus 17 has not decreased to a fixed value or less (temperature priority control). In addition, even if the temperature inside the fixing apparatus 17 has decreased to a fixed value or less, the CPU 26 may continue operation of the ventilation unit 32 if the amount of light received does not exceed the dew condensation threshold value Th1 (amount of light received priority control). By virtue of this embodiment, the ventilation unit 32 performs ventilation of the sheet sensor 31, but it may also perform ventilation of the fixing apparatus 17. In this way, the ventilation unit 32 may cool a plurality of units that the image forming apparatus 100 comprises.

Second Embodiment

The second embodiment improves on the first embodiment. The CPU 26 confirms that dew condensation has not occurred on the reflecting member 38 when supply of power from the power supply is started and the image forming apparatus 100 activates, and when the image forming apparatus 100 returns from an energy saving mode to a normal mode in accordance with a print instruction. By this, the image forming apparatus 100 can start printing in a state where dew condensation is not occurring on the reflecting member 38. Note that the normal mode is a mode in which the image forming apparatus 100 is capable of image formation, and corresponds to the print state described above. The energy saving mode is a mode in which the image forming apparatus 100 is not capable of image formation, and corresponds to the standby state described above.

Figure 8:
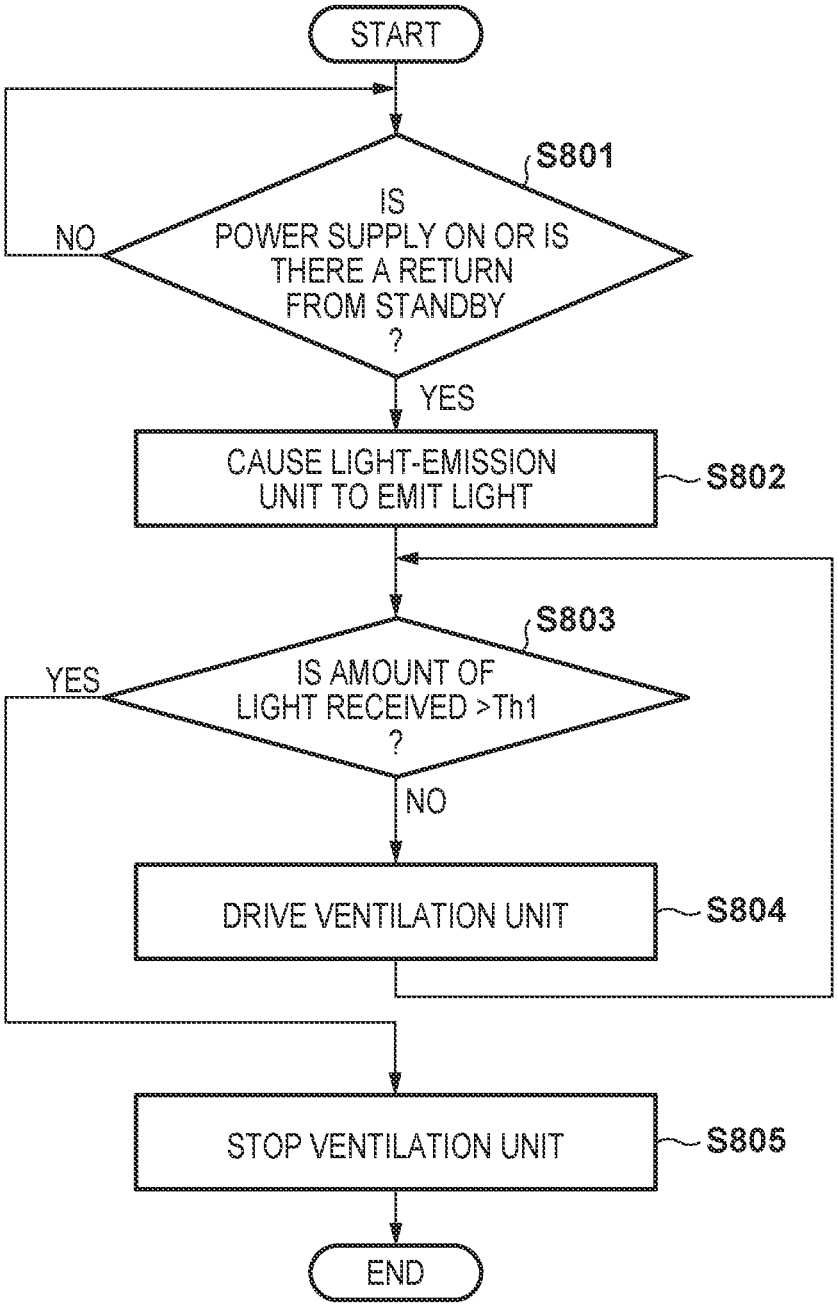
FIG. 8 is a flowchart that illustrates ventilation control.

FIG. 8 is a flowchart for illustrating a method that is executed by the CPU 26.

In step S801, the CPU 26 determines whether the image forming apparatus 100 has transitioned from the powered off state to the standby state (power on state), or whether the image forming apparatus 100 has returned from the energy saving mode to the normal mode. This step may be performed between the time t0 to the time t1 of FIG. 6, for example. If the image forming apparatus 100 has transitioned from the powered off state to the standby state, the CPU 26 advances to step S802. In addition, if the image forming apparatus 100 has returned from the energy saving mode to the normal mode, the CPU 26 advances to step S802.

In step S802, the CPU 26, via the driving circuit 56, causes the light emission unit 33 to emit light. Light outputted from the light emission unit 33 is reflected by the reflecting member 38 and is received by the light-receiving unit 34.

In step S803, the CPU 26 accepts the amount of light received obtained by the light-receiving unit 34, and determines whether the amount of light received exceeds a dew condensation threshold value Thp. Step S803 and step S705 are the same processing. If the amount of light received exceeds the dew condensation threshold value Thp, because dew condensation that would be a problem when detecting a sheet P has not occurred, the CPU 26 advances to step S805. Meanwhile, if the amount of light received does not exceed the dew condensation threshold value Thp, because there is a possibility that dew condensation that would be a problem when detecting a sheet P is occurring, the CPU 26 advances to step S804.

In step S804, the CPU 26 drives the ventilation unit 32 via the driving circuit 57. By this, cooling of the light emission unit 33 is started, and ventilation with respect to the reflecting member 38 is also started. For example, the CPU 26 starts output of a PWM signal for driving the ventilation unit 32. By this, power is supplied to the motor of the ventilation unit 32, the motor rotates the fan, and ventilation of the light emission unit 33 or the reflecting member 38 is started.

In step S805, the CPU 26 stops the ventilation unit 32 via the driving circuit 57. For example, the CPU 26 stops output of the PWM signal with respect to the ventilation unit 32. The ventilation unit 32 does not need to completely stop. For example, the CPU 26 may reduce the duty ratio of the PWM signal so that the airflow rate of the ventilation unit 32 becomes very low.

When transitioning from step S804 to step S803, the CPU 26 may wait for a predetermined wait period (for example, 5 seconds or the like). The airflow rate of the ventilation unit 32 may be set to a maximum airflow rate from airflow rates that the ventilation unit 32 can be set to. In such a case, water vapor should be reduced in the shortest amount of time. However, this airflow rate setting is merely an example. For example, the CPU 26 may calculate a difference between the amount of light received and the dew condensation threshold value Th1, and decide the airflow rate based on the difference. In addition, the CPU 26 may decide the airflow rate in accordance with power consumption management of the image forming apparatus 100. For example, the CPU 26 sets the ventilation unit 32 to the first airflow rate when the image forming apparatus 100 is operating with first power consumption. The CPU 26 sets the ventilation unit 32 to the second airflow rate when the image forming apparatus 100 is operating with second power consumption. Here first power consumption is greater than second power consumption. The first airflow rate is higher than the second airflow rate.

By virtue of this embodiment, the CPU 26 can detect an amount of light received before executing image formation, and estimate a dew condensation state of the reflecting member 38 and an occurrence level of water vapor in the vicinity based on the amount of light received. In addition, the CPU 26 starts image formation when dew condensation is sufficiently resolved or when water vapor has sufficiently reduced. By this, the CPU 26 can use the sheet sensor 31 to detect existence or absence of the sheet P with good accuracy. In this way, because the water vapor or dew condensation is sufficiently resolved before printing is started, there is less of a need to increase the airflow rate of the ventilation unit 32 when printing starts. This makes it possible to reduce total power consumption of the image forming apparatus 100 in the print state. Accordingly, by virtue of the second embodiment, total power consumption of the image forming apparatus 100 is reduced while improving sheet detection accuracy.

Third Embodiment

In the second embodiment, the CPU 26 estimates that dew condensation is a reason why the amount of light received decreases. Dirt on the light emission unit 33 or the reflecting member 38, or a decrease in the amount of light emitted from the light emission unit 33 are other reasons why the amount of light received decreases. When a decrease in an amount of light occurs due to a reason other than dew condensation in this way, sheet detection accuracy may decrease, and waste may occur in control of the ventilation unit 32. Accordingly, in the third embodiment, the CPU 26 distinguishes between a change in the amount of light due to dirt or part deterioration, and a change in the amount of light due to dew condensation. By this, the presence or absence of dew condensation is detected with good accuracy.

The CPU 26 realizes various functions by executing a control program stored in a storage apparatus 87. The storage apparatus 87 has a memory such as a RAM or a ROM, and holds the control program, a conversion table, as well as threshold values or the like. In the present embodiment, the storage apparatus 87 holds a relationship between the amount of light emitted by the light emission unit 33 and the amount of light received by the light-receiving unit 34.

Figure 9:
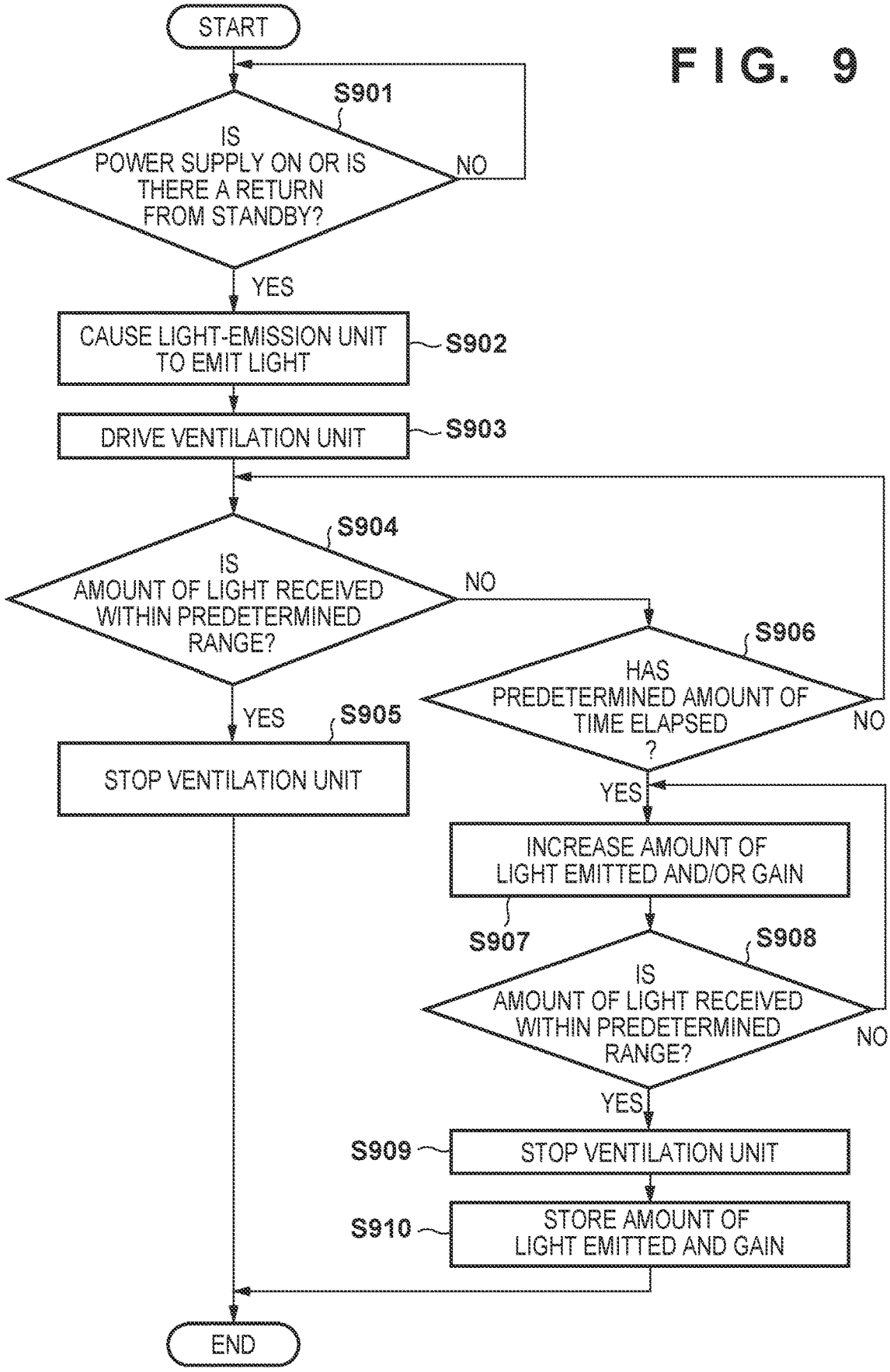
FIG. 9 is a flowchart that illustrates ventilation control.

FIG. 9 is a flowchart for illustrating a method that is executed by the CPU 26.

In step S901, the CPU 26 determines whether the image forming apparatus 100 has transitioned from the powered off state to the standby state (power on state), or whether the image forming apparatus 100 has returned from the energy saving mode to the normal mode. This step may be performed between the time t0 to the time t1 of FIG. 6, for example. If the image forming apparatus 100 has transitioned from the powered off state to the standby state, the CPU 26 advances to step S902. In addition, if the image forming apparatus 100 has returned from the energy saving mode to the normal mode, the CPU 26 advances to step S902.

In step S902, the CPU 26, via the driving circuit 56, causes the light emission unit 33 to emit light. Light outputted from the light emission unit 33 is reflected by the reflecting member 38 and is received by the light-receiving unit 34. Here, the CPU 26 reads out a light emission amount that is stored in the storage apparatus 87 in advance, and generates and outputs a driving signal in accordance with the light emission amount that was read out. The light emission amount stored in the storage apparatus 87 may be a value decided in accordance with a load inspection performed at product shipment, or a value regularly decided in a state where there is no dew condensation, for example.

In step S903, the CPU 26 drives the ventilation unit 32 via the driving circuit 57. By this, cooling of the light emission unit 33 is started, and ventilation with respect to the reflecting member 38 is also started. For example, the CPU 26 starts output of a PWM signal for driving the ventilation unit 32. By this, power is supplied to the motor of the ventilation unit 32, the motor rotates the fan, and ventilation of the light emission unit 33 or the reflecting member 38 is started. Note that the CPU 26 may start a timer or a counter in order to measure the operation duration of the ventilation unit 32.

In step S904, the CPU 26 accepts the amount of light received by the light-receiving unit 34 (an input voltage), and determines whether the amount of light received is within a predetermined range. The amount of light received is a parameter that indicates the state of the vicinity of the reflecting member 38 or dew condensation of the reflecting member 38. The predetermined range is stored in the storage apparatus 87 in advance. For example, the CPU 26 determines whether the amount of light received is within a range for the amount of light received that is stored in the storage apparatus 87. The range for the amount of light received may be defined by a lower limit value and an upper limit value. In such a case, the CPU 26 may determine whether the detected amount of light received is greater than or equal to a lower limit value, and less than or equal to the upper limit value. Alternatively, the predetermined range may be defined based on a reference amount of light received that is the center of the predetermined range, and ±Δ which is a range parameter. The CPU 26 may determine whether a difference between the detected amount of light received and the reference amount of light received is greater than or equal to −Δ and less than or equal to +Δ. Parameters that define the predetermined range may be decided at shipment of the image forming apparatus 100. For example, the reference amount of light received may be an amount of light received that is obtained when light is emitted with the aforementioned light emission amount at product shipment. In addition, the reference amount of light received may be an amount of light received that is regularly obtained in a state where there is no dew condensation. If the detected amount of light received is within the predetermined range, there is no problem due to dirt on the reflecting member 38, the light emission unit 33 or the light-receiving unit 34, and dew condensation that is a problem for the reflecting member 38 is not occurring. Accordingly, the CPU 26 advances to step S905.

In step S905, the CPU 26 stops the ventilation unit 32.

In contrast, if the detected amount of light received is outside of the predetermined range, there is a possibility of a problem due to dirt adhering to the reflecting member 38, the light emission unit 33 or the light-receiving unit 34, or dew condensation that is a problem for the reflecting member 38 is occurring. Accordingly, the CPU 26 advances to step S906. Here, firstly reduction of dew condensation by the ventilation unit 32 which was driven in step S903 is tried.

In step S906, the CPU 26 determines whether the operation duration of the ventilation unit 32 exceeds a predetermined amount of time. The predetermined amount of time is an amount of time in which it is possible to sufficiently decrease dew condensation of the reflecting member 38, and is stored in the storage apparatus 87. The ventilation unit 32 is continuously driven until the operation duration exceeds the predetermined amount of time. By this, reduction of dew condensation is tried. When the operation duration exceeds the predetermined amount of time, the CPU 26 advances the processing to step S907. When the operation duration does not exceed the predetermined amount of time, the CPU 26 advances the processing to step S904. In step S904, the CPU 26 compares the amount of light received with the predetermined range to thereby determine whether dew condensation has decreased to an allowable range. If dew condensation has decreased to the allowable range, the CPU 26 advances to step S905. If dew condensation has not decreased to the allowable range, the CPU 26 advances to step S906. If the amount of light received does not become within the predetermined range even after the ventilation unit 32 is caused to operate throughout the predetermined amount of time in this way, a factor other than dew condensation is the reason for the decrease in the amount of light received.

In step S907 and step S908, so that the detected amount of light received becomes within the predetermined range, the CPU 26 increases the amount of light emitted by the light emission unit 33, or increases the gain of the light-receiving unit 34. Generally either one of an increase of the light emission amount or a gain increase is employed. There are cases where the amount of light received does not become within the predetermined range in step S908, even after the light emission amount is increased to a maximum light amount that can be set in step S907. In such a case, the CPU 26 may start an increase of the gain in step S907. There are cases where the amount of light received does not become within the predetermined range in step S908, even after the gain is increased to a maximum gain that can be set in step S907. In such a case, the CPU 26 may start an increase of the light emission amount in step S907. When it is determined in step S908 that the amount of light received has become within the predetermined range, the CPU 26 advances to step S909.

In step S909, the CPU 26 stops the ventilation unit 32. Subsequently, in step S910, the CPU 26 stores in the storage apparatus 87 the amount of light emitted by the light emission unit 33 and the gain of the light-receiving unit 34 for the time when the determination condition was satisfied in step S908. The stored light emission amount and gain are used as initial values.

By virtue of this embodiment, dirt or dew condensation inside the image forming apparatus 100 is detected based on the amount of light received, and a reduction of dew condensation by the ventilation unit 32 is tried. In a case where a reduction of the amount of light received is not resolved even if the ventilation unit 32 is caused to operate, power consumption by the ventilation unit 32 is reduced, and the light emission amount or the gain are adjusted as appropriate. Accordingly, power consumption of the ventilation unit 32 is reduced while maintaining sheet detection accuracy.

<Summary of First Through Third Embodiments>

Figure 10:
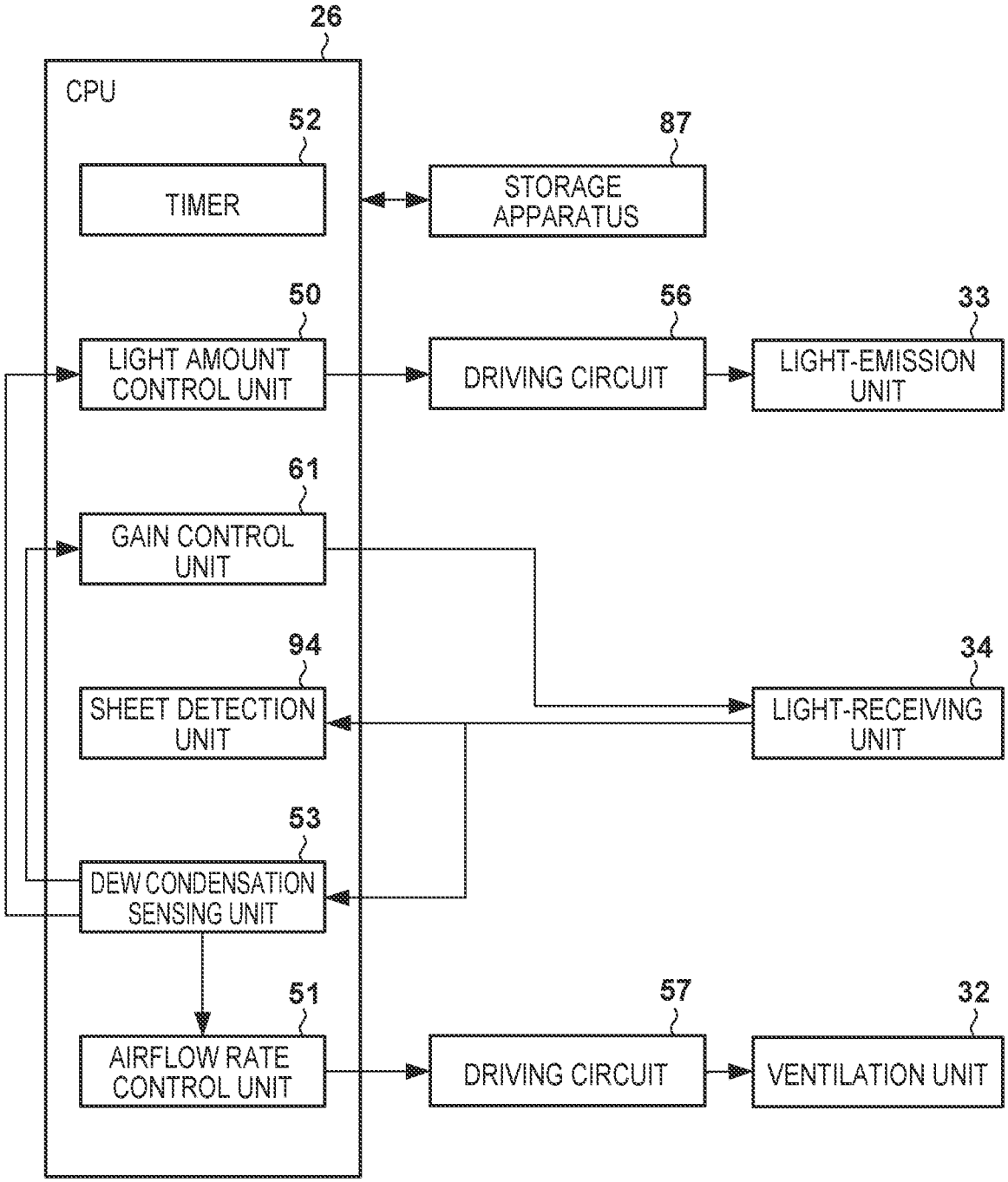
FIG. 10 is a block diagram that illustrates functions of a CPU.

FIG. 10 illustrates functions that the CPU 26 realizes by executing a control program stored in the storage apparatus 87. The CPU 26 functions as a control unit. Technical concepts derived from the foregoing embodiments are described below with reference to FIG. 10. Note that the storage apparatus 87 has a memory such as a RAM or a ROM, and holds the control program, a conversion formula, a conversion table, as well as threshold values or the like.

As illustrated in FIG. 3A or the like, the conveyance path 49 is an example of a conveyance path for conveying a sheet P. The light emission unit 33 is an example of a light-emission unit for outputting light that crosses the conveyance path 49. A light amount control unit 50 illustrated in FIG. 10 is an example of a control unit for controlling an amount of light of the light emission unit 33. The light amount control unit 50 turns on the light emitting diode D2 of the light emission unit 33 through the driving circuit 56 that has the circuit illustrated by FIG. 5B. The reflecting member 38 illustrated in FIG. 2B and the like is provided facing the light emission unit 33, and is an example of a reflecting member for reflecting incident light that has crossed the conveyance path 49. The light-receiving unit 34 is an example of a light-receiving unit that receives the light reflected from the reflecting member 38, and outputs a level detection signal in accordance with the amount of light received. The light-receiving unit 34 is an example of a light-receiving unit that receives reflected light which is light from the light emission unit 33 that has come across the conveyance path 49 at least once to reach the light-receiving unit 34. A gain control unit 61 changes the voltage generated by the phototransistor Tr4 by controlling the light-reception gain in the detection circuit illustrated by FIG. 5C. The ventilation unit 32 is an example of a ventilation unit that sends air to or sucks air from the reflecting member 38 to facilitate circulation of air around the reflecting member 38. An airflow rate control unit 51 illustrated in FIG. 10 is an example of a control unit for controlling the airflow rate of the ventilation unit 32. The airflow rate control unit 51 controls the airflow rate of the ventilation unit 32 through the driving circuit 57. A sheet detection unit 94 is an example of a determination unit for determining the existence or absence of a sheet P based on the amount of light of the reflected light received by the light-receiving unit 34. In addition, the sheet detection unit 94 is an example of a detection unit for detecting whether there is a sheet P in the conveyance path 49, based on a detection signal that the light-receiving unit 34 outputs in accordance with the amount of light received. The sheet detection unit 94 may also detect a jam of a sheet P based on a result of determining the existence or absence of a sheet P. As illustrated by FIG. 7, FIG. 8, and FIG. 9, the dew condensation sensing unit 53 adjusts at least one of an operation duration and an airflow rate of the ventilation unit 32, in accordance with the detection signal outputted by the light-receiving unit 34 when a sheet P is not at a position where light crosses the conveyance path 49. Accordingly, a sheet can be detected with good accuracy, even in an environment where dew condensation can occur. Note that the dew condensation sensing unit 53 controls the ventilation unit 32 through the airflow rate control unit 51.

As illustrated by FIG. 7, the dew condensation sensing unit 53 functions as a determination unit for determining whether the level of the detection signal outputted by the light-receiving unit 34 (amount of light received) when a sheet P is not in the conveyance path 49 exceeds the dew condensation threshold value Th1. In other words, the dew condensation sensing unit 53 has a determination unit. Here, it is assumed that the light-receiving unit 34 outputs a detection signal at a level approximately proportional to the amount of light received. In other words, the level of the detection signal may have a positive correlation with respect to the amount of light received. Note that the CPU 26 may convert the input voltage from the light-receiving unit 34 to an amount of light received, and then make a comparison with the dew condensation threshold value Th1. In other words, the input voltage may be inversely proportional to the amount of light received, and may have a negative correlation. As described above, an input voltage that is inversely proportional to the amount of light received may be compared with a voltage threshold. In such a case, in each determination step, the magnitude relationship between the amount of light received and the dew condensation threshold value Th1, and the magnitude relationship between the input voltage and the voltage threshold are reversed. If the amount of light received does not exceed the dew condensation threshold value Th1, the dew condensation sensing unit 53 increases the airflow rate of the ventilation unit 32, or continues ventilation by the ventilation unit 32. By this, dew condensation is reduced. In contrast, if the amount of light received exceeds the dew condensation threshold value Th1, the dew condensation sensing unit 53 reduces the airflow rate of the ventilation unit 32 or stops ventilation by the ventilation unit 32. By this, power that is consumed by the ventilation unit 32 is reduced. In addition, the present embodiment has the advantage that it is possible to omit a heater for removing dew condensation.

A timer 52 is an example of a measurement unit for measuring the operation duration of the ventilation unit 32. If the amount of light received does not exceed the dew condensation threshold value Th1 even if the operation duration measured by the timer 52 is greater than or equal to the predetermined amount of time, the dew condensation sensing unit 53 reduces the airflow rate of the ventilation unit 32, or stops ventilation by the ventilation unit 32. By this, power that is consumed by the ventilation unit 32 is reduced.

As illustrated by FIG. 7, the dew condensation sensing unit 53 may cause the ventilation unit 32 to operate while the image forming apparatus 100 is forming an image on a sheet P. When the image forming apparatus 100 finishes forming an image on the sheet P, the dew condensation sensing unit 53 may adjust at least one of the airflow rate and the operation duration of the ventilation unit 32, in accordance with the detection signal outputted by the light-receiving unit 34 when there is no sheet in the conveyance path 49. By this, because water vapor that occurs due to printing is diffused, it should be difficult for dew condensation on the reflecting member 38 to occur.

As illustrated by FIG. 8, the dew condensation sensing unit 53 may cause the light emission unit 33 to output light when power from a power supply is supplied and the image forming apparatus 100 activates, or when the image forming apparatus 100 returns from a state where image formation is not performed to a state where image formation can be performed. Furthermore, the dew condensation sensing unit 53 may drive or stop the ventilation unit 32 in accordance with the detection signal outputted by the light-receiving unit 34. In this way, a reduction of dew condensation is performed when power is supplied from a power supply and the image forming apparatus 100 activates or when the image forming apparatus 100 returns from a state where image formation is not performed to a state where image formation can be performed. By this, it is expected that dew condensation has sufficiently decreased at the start of printing.

As illustrated by FIG. 8, if the amount of light received does not exceed the dew condensation threshold value Th1, the dew condensation sensing unit 53 may start ventilation by the ventilation unit 32, or increase the airflow rate of the ventilation unit 32. In addition, if the amount of light received exceeds the dew condensation threshold value Th1, the dew condensation sensing unit 53 reduces the airflow rate of the ventilation unit 32 or does not perform ventilation by the ventilation unit 32. By this, the ventilation unit 32 ceases to wastefully operate, and power consumption is reduced.

As illustrated by FIG. 9, the dew condensation sensing unit 53 causes the light emission unit 33 to output light when power from a power supply is supplied and the image forming apparatus activates, or when the image forming apparatus returns from a state where image formation is not performed to a state where image formation can be performed. Furthermore, the dew condensation sensing unit 53 starts ventilation by the ventilation unit 32. In accordance the detection signal outputted by the light-receiving unit 34, the dew condensation sensing unit 53 stops the ventilation unit 32, or adjusts the amount of light emitted by the light emission unit 33 or the gain of the light-receiving unit 34. Accordingly, a sheet can be detected with good accuracy, even in an environment where dew condensation can occur.

If the amount of light received is not greater than or equal to the lower limit value of the predetermined range, the dew condensation sensing unit 53 continues ventilation by the ventilation unit 32. By this, reduction of dew condensation is tried. In contrast, if the amount of light received is greater than or equal to the lower limit value of the predetermined range, the dew condensation sensing unit 53 reduces the airflow rate of the ventilation unit 32 or stops ventilation by the ventilation unit 32. By this, power consumption is reduced.

As indicated by step S904 and step S906, if the amount of light received is not greater than or equal to the lower limit value of the predetermined range even if the operation duration measured by the timer 52 is greater than or equal to a predetermined amount of time, the dew condensation sensing unit 53 increases the amount of light emitted by the light emission unit 33, or increases the gain of the light-receiving unit 34. Note that the dew condensation sensing unit 53 controls the light emission amount through the light amount control unit 50. The dew condensation sensing unit 53 controls the gain of the light-receiving unit 34 through the gain control unit 61. By this, it is possible to detect a sheet with good accuracy, even if the amount of light received has decreased due to a factor other than dew condensation.

The dew condensation sensing unit 53 may increase both of the amount of light emitted by the light emission unit 33 and the gain of the light-receiving unit 34, and may increase one of these. The dew condensation sensing unit 53 may increase the gain of the light-receiving unit 34 if the amount of light received is not greater than or equal to the lower limit value of the predetermined range even after the amount of light emitted by the light emission unit 33 is increased to a maximum value that can be set for the light emission unit 33. The dew condensation sensing unit 53 may increase the amount of light emitted by the light emission unit 33 if the amount of light received is not greater than or equal to the lower limit value of the predetermined range, even when the gain of the light-receiving unit 34 is increased to a maximum value that can be set to the light-receiving unit 34. Note that the dew condensation sensing unit 53 may reduce the gain of the light-receiving unit 34 when the amount of light received exceeds the upper limit value of the predetermined range. Similarly, the dew condensation sensing unit 53 may reduce the amount of light emitted by the light emission unit 33 when the amount of light received exceeds the upper limit value of the predetermined range. By this, power consumption is reduced.

The storage apparatus 87 is an example of a light emission amount storage unit for storing, as an initial value, the amount of light emitted by the light emission unit 33 when the amount of light received is within the predetermined range. When emission by the light emission unit 33 starts, the dew condensation sensing unit 53 sets the initial value stored in the storage apparatus 87 to the light emission unit 33. By this, an amount of time to search for an appropriate light emission amount is reduced. The storage apparatus 87 is an example of a gain storage unit for storing, as an initial value, the gain of the light-receiving unit 34 when the amount of light received is within the predetermined range. When reception of light by the light-receiving unit 34 starts, the dew condensation sensing unit 53 sets the initial value stored in the storage apparatus 87 to the light-receiving unit 34. By this, an amount of time to search for an appropriate gain is reduced.

Note that the dew condensation sensing unit 53 may function as a sensing unit for sensing dew condensation of the reflecting member 38, or may include such a sensing unit. In such a case, the CPU 26 tries to reduce dew condensation by causing the ventilation unit 32 to operate when dew condensation of the reflecting member 38 is sensed by the dew condensation sensing unit 53.

As described using FIG. 4, the ventilation duct 40 for guiding air to the reflecting member 38 may be provided so that air that is blown out by the ventilation unit 32 or sucked in by the ventilation unit 32 blows onto the reflecting member 38. By providing the ventilation duct 40 in this way, it is possible to clean the reflecting member 38 with good efficiency, and eject water vapor that is generated from a sheet P from the vicinity of the reflecting member 38.

As illustrated by FIG. 3A or the like, the first guide 36 and the second guide 37 are provided facing each other in the conveyance path 49, and are examples of a first guide member and a second guide member for guiding a sheet P. The light emission unit 33 and the light-receiving unit 34 may be fixed to the first guide 36. The reflecting member 38 may be fixed to the second guide 37. The light-shielding member 47 is an example of a light-shielding member provided between the light emission unit 33 and the light-receiving unit 34. The light-shielding member 47 light-shields direct light that is directed from the light emission unit 33 to the light-receiving unit 34. In addition, when a sheet P is being conveyed on the conveyance path 49 in FIG. 3B, light from the light emission unit 33 mostly does not arrive at the reflecting member 38, but it reaches a surface of the sheet P. Therefore, due to the type (surface state) of the sheet P, there is the possibility for light to be reflected by the surface of the sheet P and for this reflected light to be directed to the light-receiving unit 34. When such reflected light is received by the light-receiving unit 34, there is the possibility for the light-receiving unit 34 to output a detection signal indicating that a sheet P is not detected, despite the sheet P being conveyed on the conveyance path 49. Accordingly, the light-shielding member 47 may be configured so that at least some of such reflected light that is reflected by the surface of the sheet P and is directed to the light-receiving unit 34 is light-shielded. By this, the existence or absence of a sheet P should be detected with good accuracy.

According to FIG. 2A and the like that are described above, light outputted from the light emission unit 33 crosses the conveyance path 49 to be incident on the reflecting member 38, and the light reflected from the reflecting member 38 crosses the conveyance path 49 to be incident on the light-receiving unit 34. In this way, the light outputted from the light emission unit 33 crosses the conveyance path 49 twice, but it is sufficient if the number of times that light crosses the conveyance path 49 is one or more. For example, configuration may be taken such that light outputted from the light emission unit 33 is incident on the reflecting member 38 without crossing the conveyance path 49, and the light reflected from the reflecting member 38 crosses the conveyance path 49 to be incident on the light-receiving unit 34. In addition, configuration may be taken such that light outputted from the light emission unit 33 crosses the conveyance path 49 to be incident on the reflecting member 38, and the light reflected from the reflecting member 38 is incident on the light-receiving unit 34 without crossing the conveyance path 49. The number of times that light crosses the conveyance path 49 may be one. Configuration may be taken such that light outputted from the light emission unit 33 crosses the conveyance path 49 to be incident on the reflecting member 38, light reflected from the reflecting member 38 also crosses the conveyance path 49 to be incident on a second reflecting member, and light reflected from the second reflecting member is incident on the light-receiving unit 34. In this way, the number of times that light crosses the conveyance path 49 may be three. By increasing the number of reflecting members, it is possible to increase the number of times that light crosses the conveyance path 49. In this way, light that crosses the conveyance path 49 may be light that crosses the conveyance path 49 one or more times from when it is outputted from the light emission unit 33 until it is incident on the light-receiving unit 34. In addition, a timing when light outputted from the light emission unit 33 crosses the conveyance path 49 may be before or after it is incident on the reflecting member 38. In any case, the light emission unit 33 functions as a light-emission unit for outputting light that crosses a conveyance path. In addition, it is sufficient if the number of reflecting members 38 installed between the light emission unit 33 and the light-receiving unit 34 is one or more. The arrangement of the light emission unit 33 and the light-receiving unit 34 differ in accordance with the number of times that light crosses the conveyance path 49. If the number of times that light crosses the conveyance path 49 is even, the light emission unit 33 and the light-receiving unit 34 are arranged on the same side seen from the conveyance path 49, as illustrated by FIG. 2A. If the number of times that light crosses the conveyance path 49 is odd, the light emission unit 33 and the light-receiving unit 34 are arranged on sides opposite one another across the conveyance path 49.

Fourth Embodiment

An optical sheet sensor has a light-emission element and a light-receiving element, and detects a sheet in accordance with whether light is blocked by the sheet. In comparison to a mechanical flag type sheet sensor, and optical sheet sensor is advantageous in responsiveness and improves the productivity of an image forming apparatus. An optical sheet sensor increases a manufacturing cost in comparison to a mechanical flag type sheet sensor. Accordingly, if an optical sheet sensor has another function in addition to a sheet detection function, the cost-versus-effect of the sheet sensor is improved. Accordingly, it is necessary to improve the cost-versus-effect of a sheet sensor.

<Image Forming Apparatus>

Figure 11:
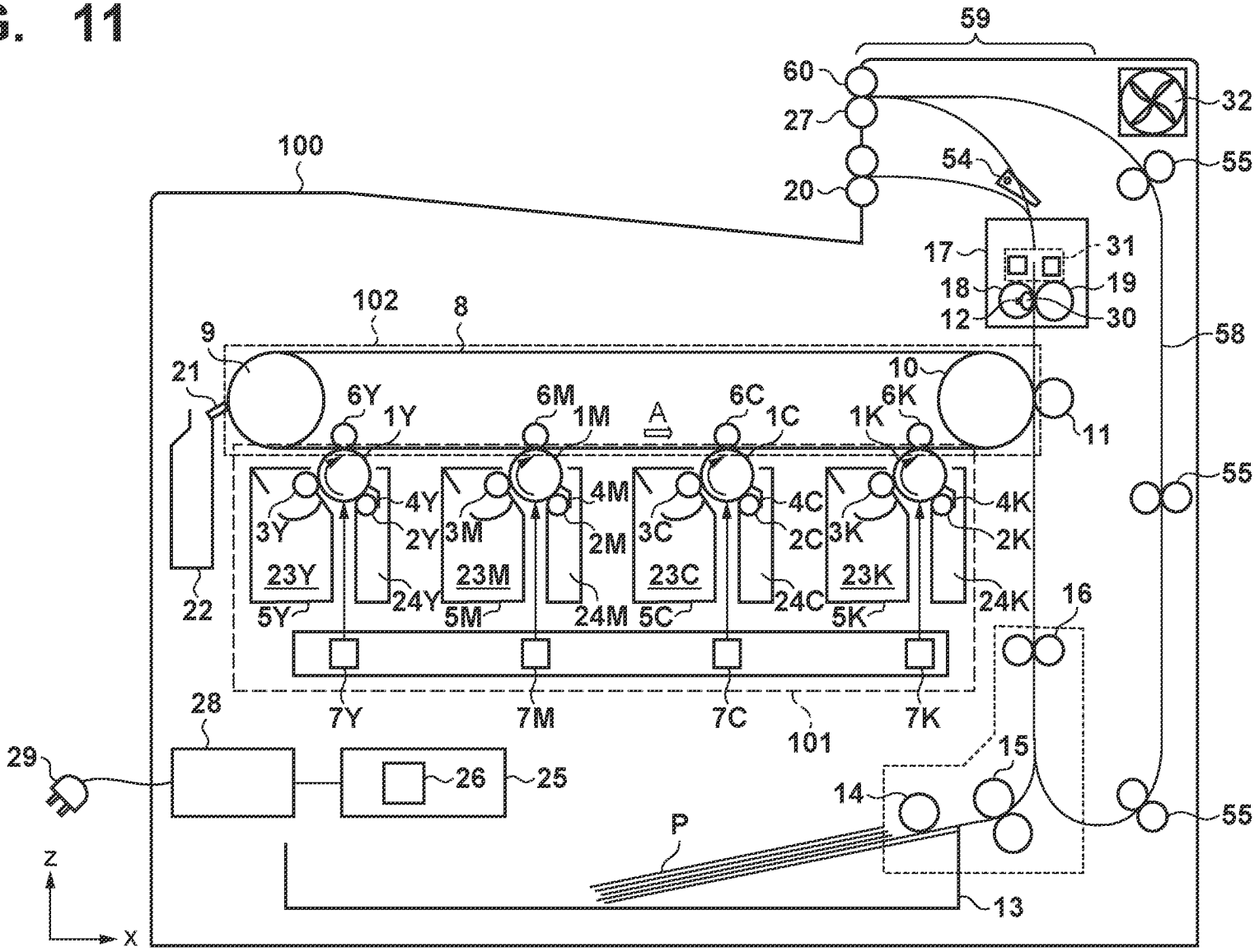
FIG. 11 is an overview cross-sectional view of the image forming apparatus in a first embodiment.

In comparison to the image forming apparatus 100 illustrated in FIG. 1, a function relating to double-sided printing has been added to the image forming apparatus 100 illustrated in FIG. 11.

In the case of a single-sided print mode, a sheet P discharged from the fixing apparatus 17 is conveyed by a flapper 54 to the discharge rollers 20. Note that the conveyance path that exists from the flapper 54 to the discharge rollers 20 may be referred to as a discharge path. The discharge rollers 20 discharge a sheet P to outside of the image forming apparatus 100.

In the case of a double-sided print mode, an orientation of the flapper 54 switches so that a sheet P is conveyed to reversing rollers 27, and the sheet P is conveyed to the reversing rollers 27. The conveyance path from the flapper 54 to the reversing rollers 27 may be referred to as a drawing path. The reversing rollers 27 perform a forward rotation to draw the sheet P, and then perform a reverse rotation to feed sheets P to a double-sided conveyance path 58. At this time, the leading edge of the sheet P is exposed outside of the image forming apparatus 100 from an opening 60 of the double-sided conveyance path 58, but the trailing edge of the sheet P is not exposed. By the rotation direction of the reversing rollers 27 switching, the leading edge of the sheet P switches to the trailing edge, and the trailing edge of the sheet P switches to the leading edge. By this, an image formation side of the sheet P switches from a first surface to a second surface. A timing for the switch from forward rotation to reverse rotation may be decided based on a timing when the trailing edge of the sheet P is detected by the sheet sensor 31. From the double-sided conveyance path 58, a conveyance guide member 59 is provided between the reversing rollers 27 and the ventilation unit 32. A plurality of pairs of conveyance rollers 55 provided on the double-sided conveyance path 58 convey the sheet P along the double-sided conveyance path 58, and transfer the sheet P to the registration rollers 16. The image forming unit 101 forms an image of the second surface of the sheet P, and discharges the sheet P by the flapper 54 and the discharge rollers 20.

The ventilation unit 32 is arranged so supply air to the double-sided conveyance path 58, for example.

<Water Vapor Detection Algorithm>

The CPU 26 estimates an amount of water vapor that has occurred (a water vapor amount) based on the amount of light received by the light-receiving unit 34 in the sheet sensor 31. When the sheet P passes through the fixing apparatus 17, moisture that had adhered to the sheet P evaporates and water vapor occurs. When water vapor occurs inside the conveyance path 49, light emitted by the light emission unit 33 that crosses the conveyance path 49 is diffusely reflected by the water vapor. Consequently, the amount of light received by the light-receiving unit 34 reduces. In other words, the reduction of the amount of light received correlates to the water vapor amount. Accordingly, the CPU 26 causes the light emission unit 33 to output light and obtains the amount of light received by the light-receiving unit 34 when a sheet P is not at a detection position for the sheet sensor 31. A detection position is a position where light crosses the conveyance path 49. Here, it is assumed that the light-receiving unit 34 outputs a detected voltage that is inversely proportional (an inverse relationship) with the amount of light received. When the detected voltage from the light-receiving unit 34 exceeds a threshold value that is defined in advance, the CPU 26 estimates that the amount of light received has decreased (that there is a large amount of water vapor that has occurred). When the detected voltage does not exceed the threshold value, the CPU 26 determines that the amount of light received is greater than or equal to a certain amount. In other words, the CPU 26 estimates that there is a low amount of water vapor that has occurred inside the conveyance path 49.

Here, description is given for a result of experimentally verifying how the voltage detected by the light-receiving unit 34 changes in accordance with the moisture absorption state of a sheet P. A typical office environment is envisioned as a condition of the experiment. Accordingly, an environment for the image forming apparatus 100 is set to one where the temperature is set to 25° C., and the relative humidity is set to 50%. Two types of sheets P having different moisture absorption states are prepared. In other words, ten sheets P in a first moisture absorption state, and ten sheets P in a second moisture absorption state are prepared. The CPU 26 causes ten sheets P to consecutively pass through the fixing apparatus 17, and monitors the voltage detected by the light-receiving unit 34. The sheets P are plain paper (grammage: 80 g/m$^2$) that are commonly distributed. The proportion of moisture included in the sheets P in the first moisture absorption state was 4.3%. The proportion of moisture included in the sheets P in the second moisture absorption state was 8.3%. When the relative humidity of the conveyance path 49 immediately after the ten sheets P in the first moisture absorption state were caused to pass through the fixing apparatus 17 was measured by a humidity sensor, it was 63%. When the relative humidity of the conveyance path 49 immediately after the ten sheets P in the second moisture absorption state were caused to pass through the fixing apparatus 17 was measured by a humidity sensor, it was 73%. From this, it is understood that the water vapor amount retained in the conveyance path 49 or the like was high when the sheets P having more moisture were supplied to the fixing apparatus 17.

Figure 12A:
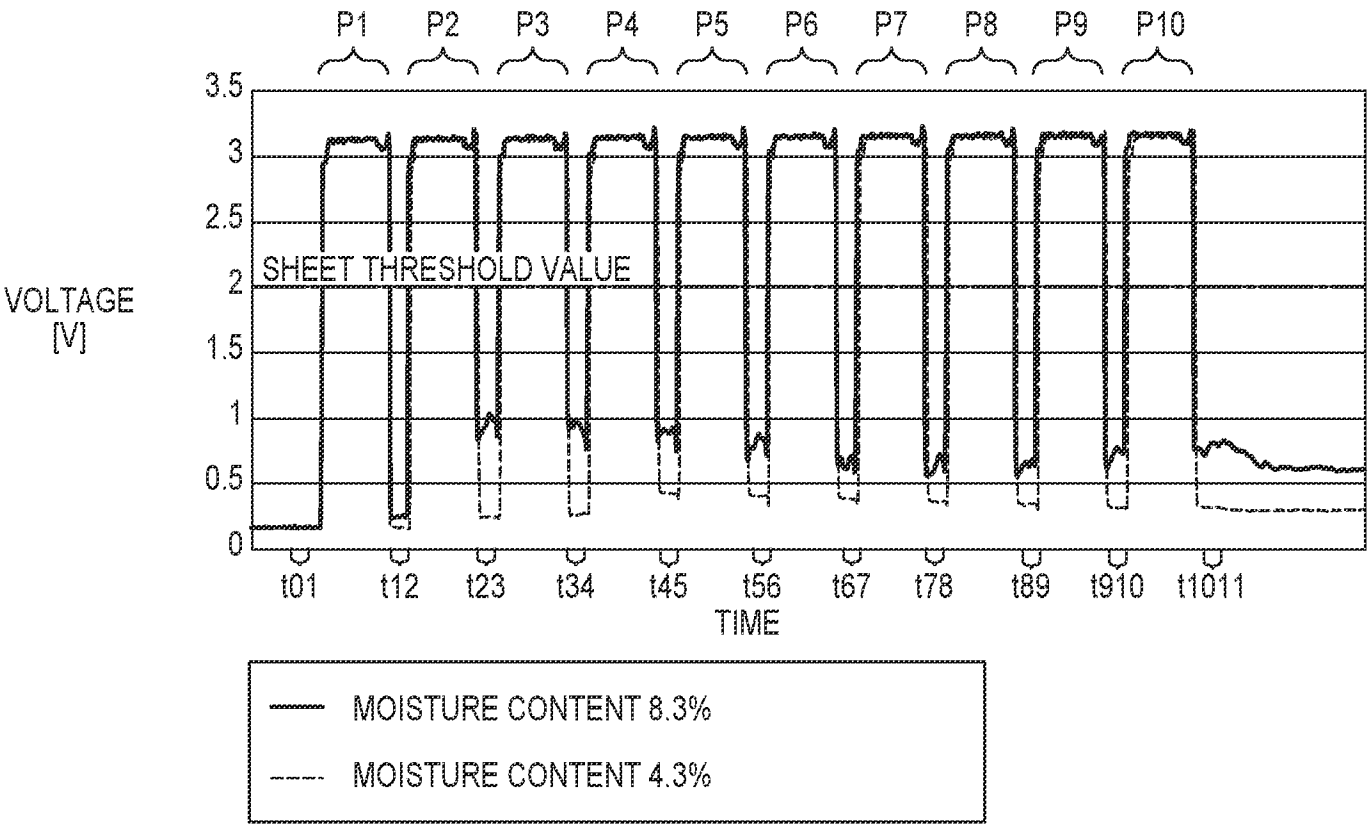
FIGS. 12A and 12B are views for describing parameters relating to a water vapor amount.

FIG. 12A illustrates a voltage output result for the light-receiving unit 34. The abscissa indicates time. The ordinate indicates the voltage detected by the light-receiving unit 34. The lower the detected voltage, the greater the amount of light received (no sheet). The higher the detected voltage, the lower the amount of light received (sheet present). A reason why the detected voltage fluctuates up and down is because a state where a sheet P is present at a detection position and a state where a sheet P is not present at a detection position are repeated in order to consecutively feed 10 sheets P1 to P10. The first projecting waveform indicates that the first sheet is passing through the detection position. Solid lines indicate a detected voltage waveform for the sheets P in the second moisture absorption state that has high moisture. Broken lines indicate a detected voltage waveform for the sheets P in the first moisture absorption state that has low moisture.

Comparing the voltage waveform for the first moisture absorption state and the voltage waveform for the second moisture absorption state, it is understood that initial voltages (sheet interval t01) before a first sheet P1 is detected are both 0.16 V. Note that a sheet interval tij is a period of time corresponding to the distance between the trailing edge of a preceding sheet Pi and the leading edge of a succeeding sheet Pj (j=i+1). When the leading edge of the first sheet P1 reaches a detection position, the voltage for the first moisture absorption state and the voltage for the second moisture absorption state both increase to 3.1 V. Here, a sheet threshold value for determining the existence or absence of a sheet P is set to 2.0 V. Accordingly, the CPU 26 can detect the presence of a sheet in both moisture absorption states. When the trailing edge of the sheet P1 reaches a detection position, the voltage for the first moisture absorption state and the voltage for the second moisture absorption state both decrease to less than or equal to the sheet threshold value. At a sheet interval t12 between the sheet P1 and the sheet P2, the voltage for the second moisture absorption state was 0.24 V, and the voltage for the first moisture absorption state was 0.17 V. A concept referred to as rate of increase of the detected voltage at each sheet interval, with respect to the initial voltage and based on the potential difference between 0 V and 3.1 V is introduced.

$$\text{Rate of increase } \Delta V = ((\text{detected voltage} - \text{initial voltage})/3.1) \times 100[\%] \quad (1)$$

The rate of increase ΔV for the second moisture absorption state at the sheet interval t12 is 2.5%. The rate of increase ΔV for the first moisture absorption state at the sheet interval t12 is 0.3%. Accordingly, the difference between these (difference in rates of increase) is 2.2%.

Figure 12B:
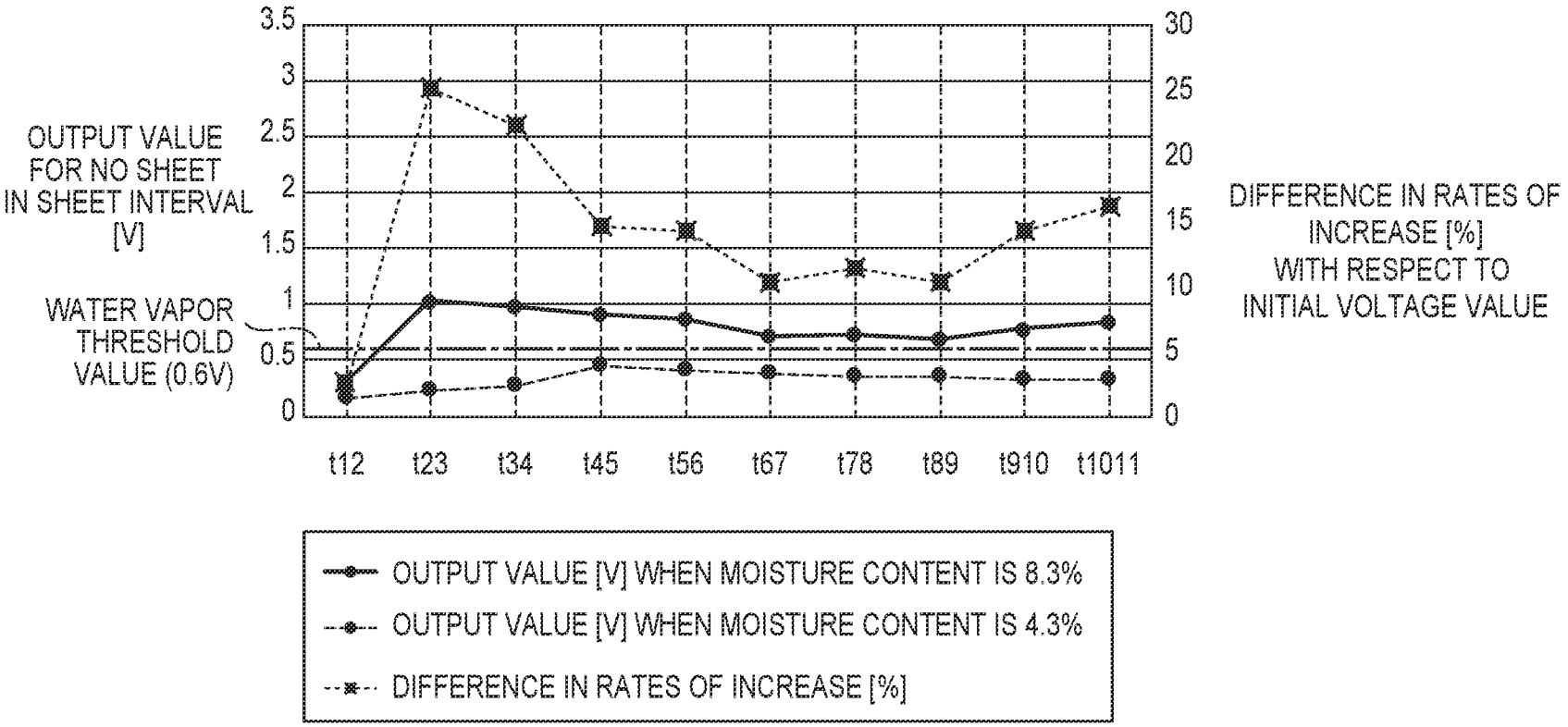

FIG. 12B illustrates the detected voltage and difference in rates of increase in each sheet interval. In FIG. 12B, the ordinate on the left side indicates the detected voltage [V] in each sheet interval. The ordinate on the right side in FIG. 12B indicates the difference in rates of increase [%]. In all sheet intervals t01 to t910, the detected voltage for the sheets P having high moisture exceeds the voltage detected for the sheets P having low moisture. The average value of the difference in the rates of increase at each sheet interval was approximately 14%. Here, if a water vapor threshold value for determining the size of a water vapor amount is set to 0.6 V, the detected voltage for the second and subsequent sheets P having high moisture all exceed the water vapor threshold value as illustrated by FIG. 12B. Accordingly, the CPU 26 can estimate that the second and subsequent sheets P that have high moisture are all sheets with high moisture. The sheets P with high moisture indicates the sheets P for which the proportion of moisture included therein is 8.0% or more. The water vapor threshold value can be arbitrarily changed.

The foregoing algorithm for estimating the water vapor amount is merely an example. For example, the water vapor amount may be estimated based on the rate of increase instead of the difference in rates of increase. By employing this estimation method, the impact of manufacturing variation or the position where a part is installed is reduced. This variation includes variation of an installation position of the light-emission element or the light-receiving element, variation of electrical properties, variation of relative positional relationship between the substrate 35 and the reflecting member 38, or the like. Such variation leads to variation of the detected voltage. Accordingly, threshold values may be set in consideration of such variation. There is no need for the water vapor amount to be estimated each single sheet P, and the water vapor amount may be estimated every n sheets P. For example, configuration may be taken such that the CPU 26 cumulatively adds together n rates of increase obtained for each of n sheets, and, when this addition result exceeds a threshold value, estimates that sheets P contained in the feed cassette 13 are sheets P that contain a lot of moisture. By employing such an estimation method, the estimation accuracy of the moisture absorption state of the sheets P (the water vapor amount in the conveyance path 49) improves.

<Ventilation Unit>

Figure 13:
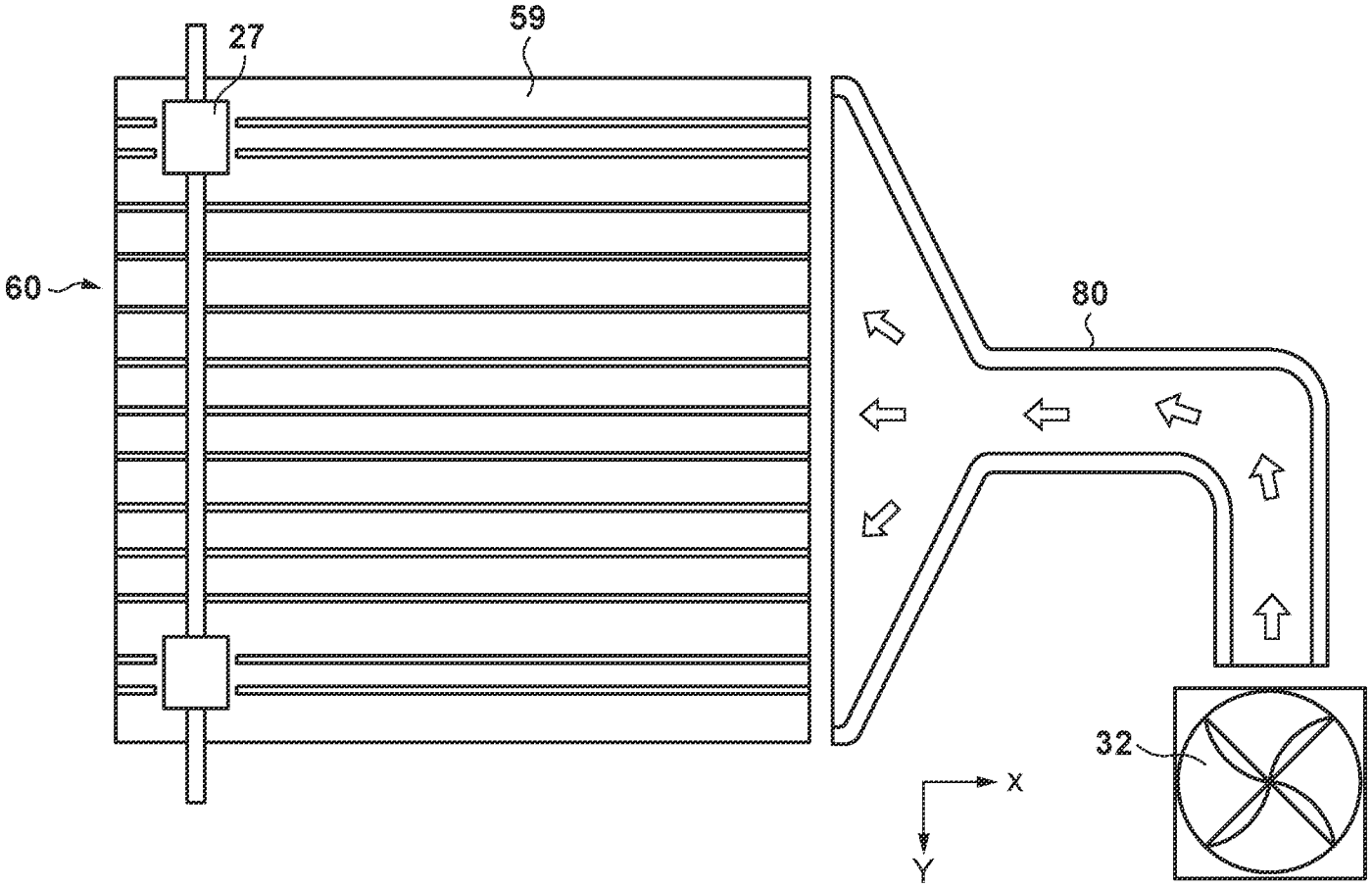
FIG. 13 is a plan view that illustrates a ventilation duct.

The CPU 26 may control the image forming apparatus 100 using a result of estimating the water vapor amount. Control of the ventilation unit 32 using the water vapor amount is exemplified here. FIG. 13 is a cross-sectional diagram of a ventilation duct 80 and the ventilation unit 32 which supply air inside the double-sided conveyance path 58. Arrow symbols in FIG. 13 indicate the flow of air. The ventilation duct 80 guides air blown out from the ventilation unit 32 to the conveyance guide member 59 which forms a part of the double-sided conveyance path 58. The air blown out to the conveyance guide member 59 proceeds in an opposite direction to the conveyance direction of the sheet P in the double-sided conveyance path 58, following conveyance surfaces of the conveyance guide member 59. This air is discharged outside of the image forming apparatus 100 from the opening 60 provided at the reversing rollers 27. A reason for performing this ventilation is to discharge water vapor, which is generated from the sheet P and enters the double-sided conveyance path 58, to outside of the image forming apparatus 100. By this, water vapor becoming waterdrops and adhering to the double-sided conveyance path 58 is suppressed. Waterdrops that have adhered to the double-sided conveyance path 58 should be removed in accordance with an effect of drying by ventilation. When waterdrops that have adhered inside the double-sided conveyance path 58 adhere to the second surface of the sheet P, it becomes difficult for toner to be transferred due to the waterdrops. Accordingly, by reducing waterdrops, image defects due to waterdrops are reduced.

<Ventilation Control>

Figure 14:
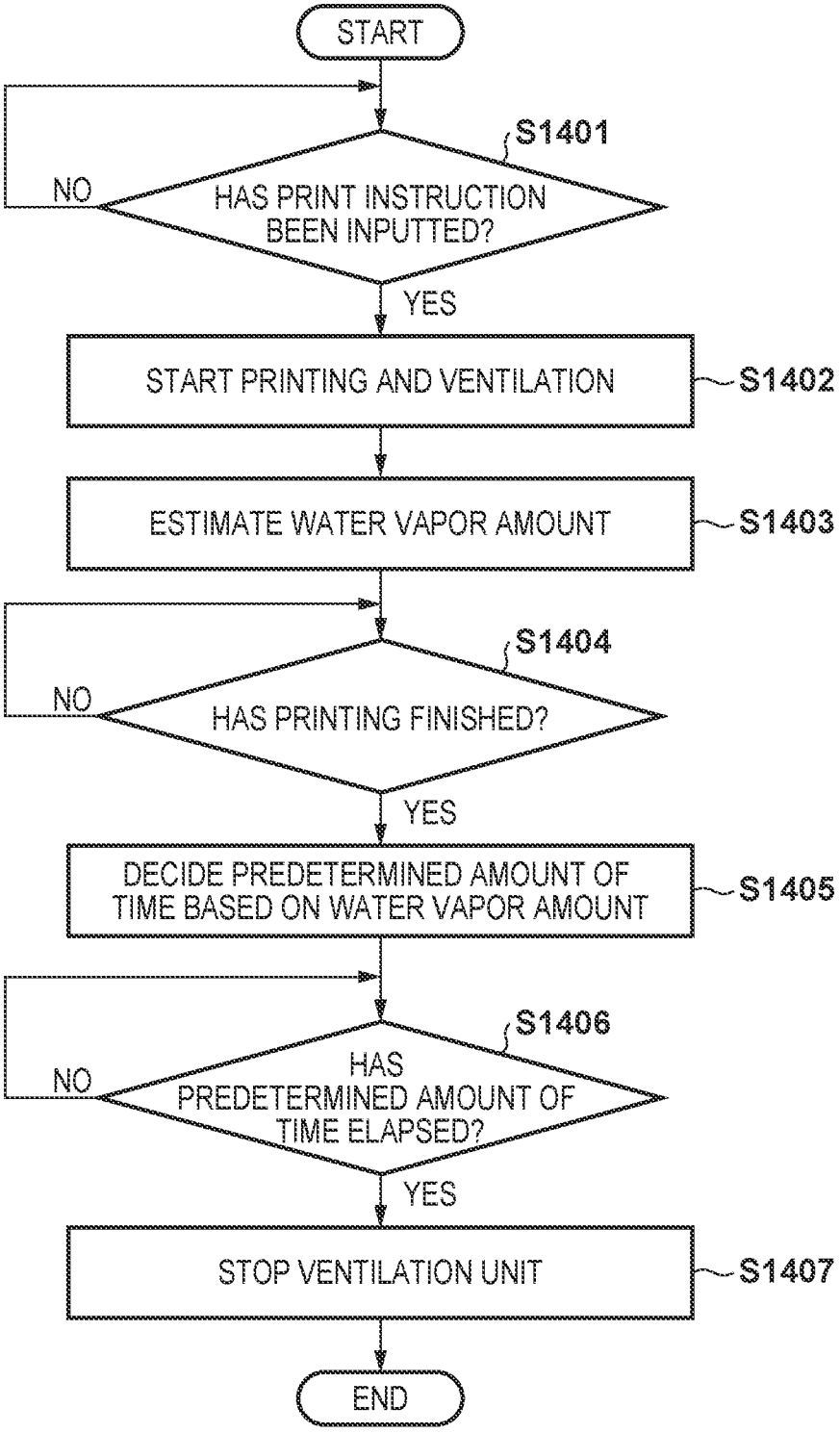
FIG. 14 is a flowchart that illustrates ventilation control.

As illustrated by FIG. 6, at a time t0, power is supplied from a power supply, and the image forming apparatus 100 activates. In other words, at the time t0 the image forming apparatus 100 transitions from a powered off state to a standby state. FIG. 14 is a flowchart for illustrating control that is executed by the CPU 26.

In step S1401, the CPU 26 determines whether a print instruction (an image forming instruction) has been inputted from an operation unit or an external computer. According to FIG. 6, a print instruction is inputted at a time t1. Note that, from the time t0 to the time t1, the state of the image forming apparatus 100 is the standby state for awaiting a print instruction. The ventilation unit 32 does not operate in the standby state immediately after the image forming apparatus 100 activates (airflow rate=0). Note that the CPU 26 may drive the ventilation unit 32 so that there is a very low airflow rate. When the print instruction is inputted at the time t1, the CPU 26 advances to step S1402 in order to start image formation.

In step S1402, the CPU 26 controls the image forming apparatus 100 to start printing. Furthermore, the CPU 26 drives the ventilation unit 32 to start ventilation of the conveyance guide member 59. For example, the CPU 26 starts output of a PWM signal for driving the ventilation unit 32. By this, the driving circuit 57 supplies power to the motor of the ventilation unit 32, the motor rotates the fan, and ventilation of the conveyance guide member 59 is started. By this, a flow of air that follows the conveyance surfaces of the conveyance guide member 59 is formed, and water vapor is discharged from the opening 60.

In step S1403, the CPU 26 obtains the amount of light received in the sheet interval from the sheet sensor 31, and estimates a water vapor amount at the conveyance path 49 based on the amount of light received. Note that estimation of water vapor may be performed at least one time during printing. When a plurality of estimations are performed, the average value of a plurality of estimation results may be employed.

In step S1404, the CPU 26 determines whether printing has ended. The CPU 26 determines whether a print job designated by the operation unit or the like has entirely completed. If a print job is a job for forming images onto n sheets, a determination is made as to whether forming an image onto the n-th sheet has completed. When printing ends at a time t3, the CPU 26 proceeds to step S1405.

In step S1405, the CPU 26 decides the predetermined amount of time Tx based on the result of estimating the water vapor amount. As illustrated by FIG. 6, the predetermined amount of time Tx is the operation duration from a timing when printing ends until a timing for stopping the ventilation unit 32. The greater the water vapor amount, the longer the predetermined amount of time Tx. The lower the water vapor amount, the shorter the predetermined amount of time Tx.

In step S1406, the CPU 26 determines whether an elapsed amount of time from the timing when printing ended (the time t3) has become a predetermined amount of time Tx. The CPU 26 uses a timer or a counter to measure the elapsed amount of time since the end of printing. According to FIG. 6, the elapsed amount of time becomes the predetermined amount of time Tx at a time t4. The predetermined amount of time Tx is the amount of time necessary to mostly resolve waterdrops that have adhered to the conveyance surface of the conveyance guide member 59. The predetermined amount of time Tx fluctuates, depending on the moisture absorption state of sheets P conveyed during printing, a number of sheets that are conveyed, or the like. When the elapsed amount of time becomes the predetermined amount of time Tx, the CPU 26 advances the processing to step S1407.

In step S1407, the CPU 26 stops the ventilation unit 32. For example, the ventilation unit 32 stops output of the PWM signal, or reduces the duty ratio of the PWM signal. Note that the ventilation unit 32 does not need to completely stop. For example, the duty ratio of the PWM signal may be changed so that the airflow rate of the ventilation unit 32 becomes very low.

Algorithm for Deciding the Predetermined Amount of Time Tx

The moisture absorption state of a sheet P conveyed during printing is estimated by the algorithm for estimating water vapor. The CPU 26 decides the predetermined amount of time Tx based on an estimation result, and the number of sheets P conveyed in an immediately prior print job.

Figure 15:
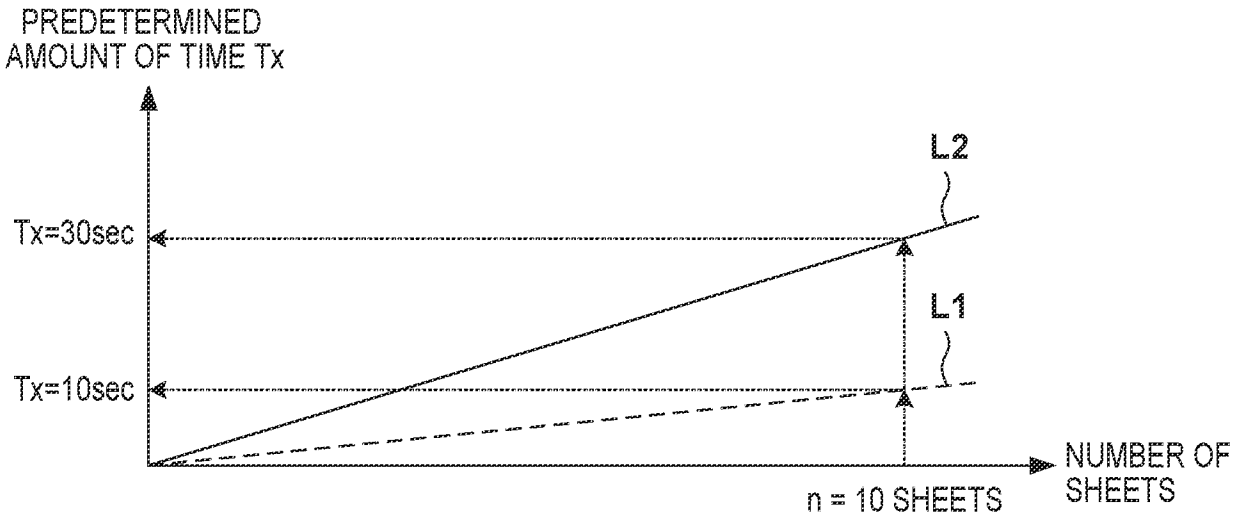
FIG. 15 is a view for describing a method of deciding an operation duration.

FIG. 15 is a graph for describing a method for estimating the predetermined amount of time Tx. The abscissa indicates the number of sheets conveyed during printing. The ordinate indicates the predetermined amount of time Tx. Two straight lines L1 and L2 having different angles are selected in accordance with water vapor amounts. The straight line L1 is selected when the water vapor amount is low. The straight line L2 is selected when the water vapor amount is high. In a case where the number of sheets n is 10 and the water vapor amount is low, the CPU 26 selects the straight line L1, and decides the predetermined amount of time Tx corresponding to 10 sheets to be 10 seconds. In a case where the number of sheets n is 10 and the water vapor amount is high, the CPU 26 selects the straight line L2, and decides the predetermined amount of time Tx corresponding to 10 sheets to be 30 seconds. An angle a1 of the straight line L1 is decided based on the time required for reduction of waterdrops in accordance with experimentation performed when the water vapor amount is low. Similarly, an angle a2 of the straight line L2 is decided based on the time required for reduction of waterdrops in accordance with experimentation performed when the water vapor amount is high. A linear function (an equation for a straight line) for obtaining the predetermined amount of time Tx from the number of sheets n and the angle a is employed here, but a higher-order function may be decided based on experimental results.

According to the fourth embodiment, the CPU 26 estimates the water vapor amount (the moisture absorption state of a sheet) in accordance with the amount of light received by the light-receiving unit 34. Hypothetically, when the operation duration (the predetermined amount of time Tx) of the ventilation unit 32 is set without considering the moisture absorption state of a sheet P, it can be considered that the operation duration becomes excessive or the operation duration becomes insufficient. If the operation duration is insufficient, waterdrops should remain in the conveyance guide member 59. In contrast, if the operation duration is excessive, the amount of power consumption will increase. Accordingly, by deciding the operation duration in accordance with the water vapor amount (the moisture absorption state of a sheet), waterdrops should be sufficiently reduced, and an increase in the amount of power consumption should be suppressed. In addition, it should be difficult for an image defect due to a waterdrop to occur. For a sheet P with low moisture, the operation duration of the ventilation unit 32 can be reduced, and a waiting time period longer than is necessary should not occur.

In the fourth embodiment, a sequence in which the operation duration of the ventilation unit 32 after the end of a print job is controlled, in accordance with the amount of light received, is exemplified. Instead of changing the operation duration of the ventilation unit 32, the CPU 26 may change the airflow rate of the ventilation unit 32 in accordance with the amount of light received. For example, the CPU 26 may change the duty ratio of the PWM signal in accordance with the amount of light received. When the image forming apparatus 100 activates at the time t0, the ventilation unit 32 is driven so as to have the first airflow rate (which may be zero). In addition, at the time t1, the ventilation unit 32 is driven so that its airflow rate becomes the second airflow rate (the second airflow rate>the first airflow rate). From the time t3 to the time t4, the ventilation unit 32 continues to perform ventilation at the second airflow rate. At the time t4, the airflow rate of the ventilation unit 32 is reduced from the second airflow rate to the first airflow rate (which may be zero). Note that the CPU 26 may control the airflow rate of the ventilation unit 32 to be zero from the time t0 until the time t1, control the airflow rate to be the first airflow rate (>0) from the time t1 until the time t2, and control the airflow rate to be the second airflow rate (>the first airflow rate) from the time t2. Here, the time t2 is a time between the time t1 and the time t3 in FIG. 6. In particular, upon finalizing an estimation result at the time t2, the CPU 26 may decide the second airflow rate based on the estimation result. When the water vapor amount is high, the second airflow rate is set relatively high. When the water vapor amount is low, the second airflow rate is set relatively low.

In the fourth embodiment, one estimation result is obtained in one sheet interval tij. However, many estimation results may be obtained in one sheet interval tij and fed back for control of the image forming apparatus 100. By this, control of the image forming apparatus 100 should be more detailed. There are cases where the image forming apparatus 100 is provided with an environment sensor that can obtain environment information such as the humidity or temperature of the vicinity in real time. The CPU 26 may estimate the water vapor amount with more accuracy based on the amount of light received obtained by the sheet sensor 31 and environment data obtained by the environment sensor. For example, the CPU 26 may convert the environment data to a correction coefficient and use the correction coefficient to correct an estimation result.

Note that, in the fourth embodiment, the ventilation unit 32 supplies air to the double-sided conveyance path 58. In addition to this, the ventilation unit 32 may supply air to the reflecting member 38 as described in the first through third embodiments. In other words, one ventilation duct that extends from one fan may be caused to branch into two ventilation ducts. Configuration may be taken such that one ventilation duct is directed to the double-sided conveyance path 58, and the other ventilation duct is directed to the reflecting member 38. In addition, simply one fan for supplying air to the double-sided conveyance path 58, and one fan for supplying air to the reflecting member 38 may be arranged.

Fifth Embodiment

The fifth embodiment is something that feeds back a result of estimating the water vapor amount to a curl correcting (straightening) mechanism. By passing a sheet P through the fixing apparatus 17, curling of the sheet P may occur. If the sheet P curls, there are cases where it clogs in the double-sided conveyance path 58 or the like. Accordingly, a curl correcting mechanism is useful.

Figure 16:
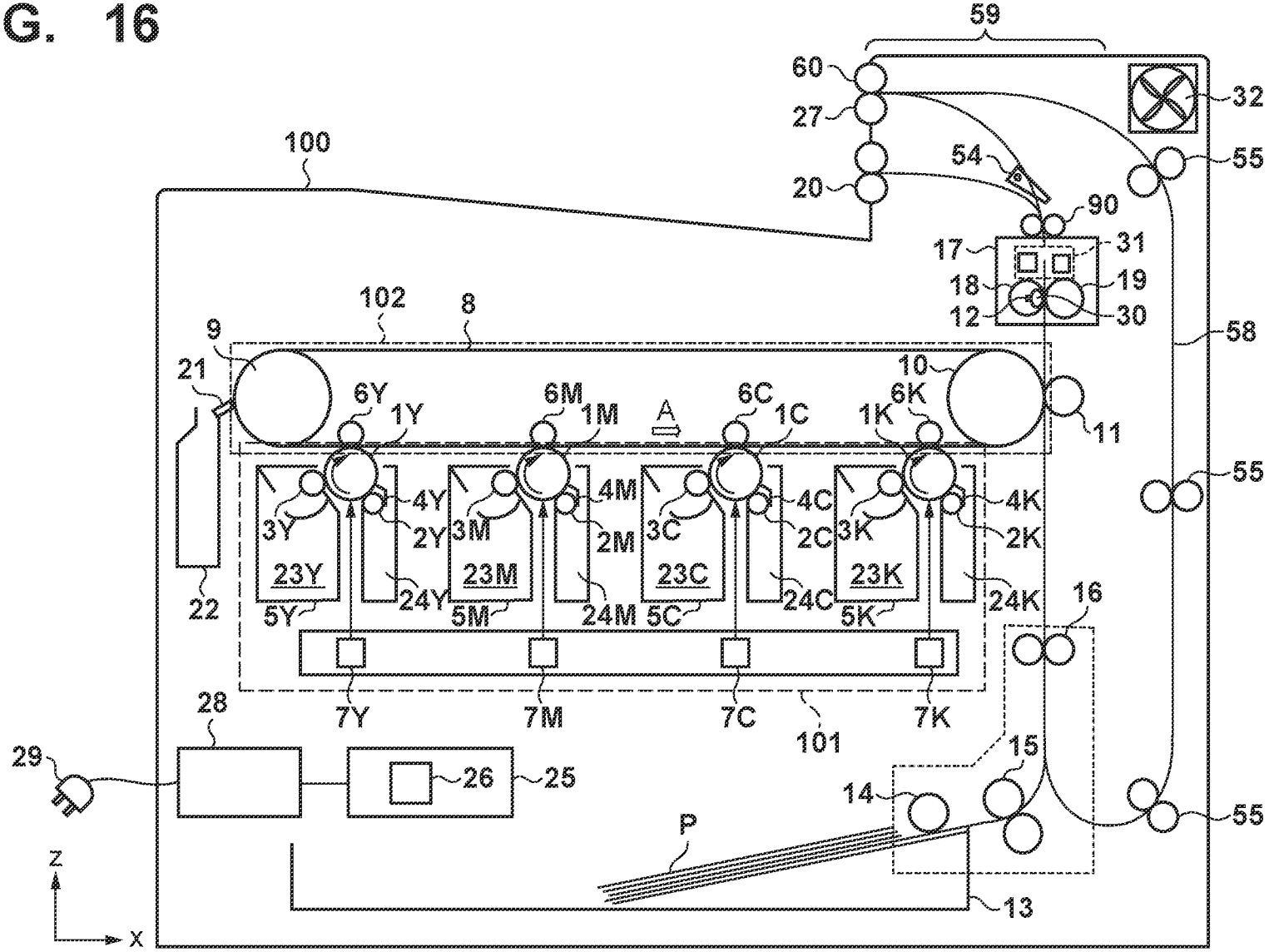
FIG. 16 is an overview cross-sectional view of the image forming apparatus in a fifth embodiment.

FIG. 16 is a cross-sectional diagram of the image forming apparatus 100 in the fifth embodiment. In the fifth embodiment, a point of difference with the fourth embodiment is that a curl correcting mechanism is arranged downstream of the fixing apparatus 17. The curl correcting mechanism has a de-curling roller pair 90. By a sheet P passing through a nipping portion of the de-curling roller pair 90, curling of the sheet P is reduced.

<Sheet Sensor>

Figure 17A:
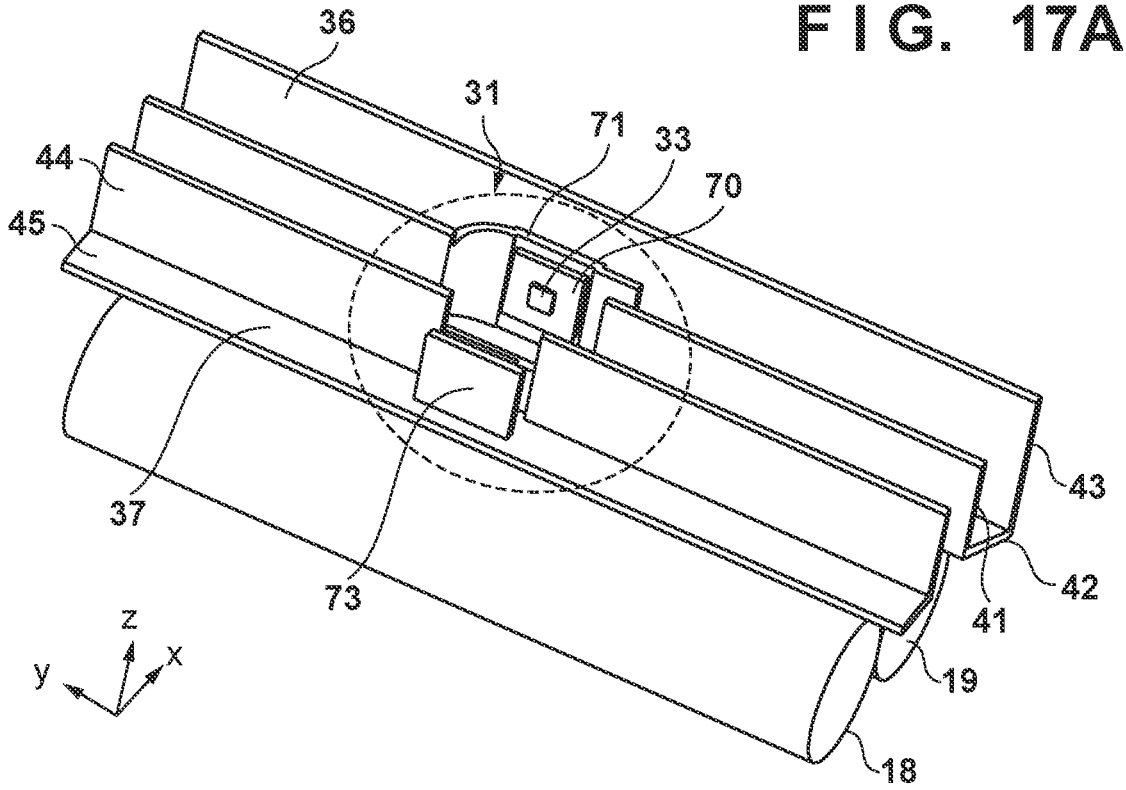
FIGS. 17A and 17B are perspective views of the sheet sensor in a fifth embodiment.
Figure 17B:
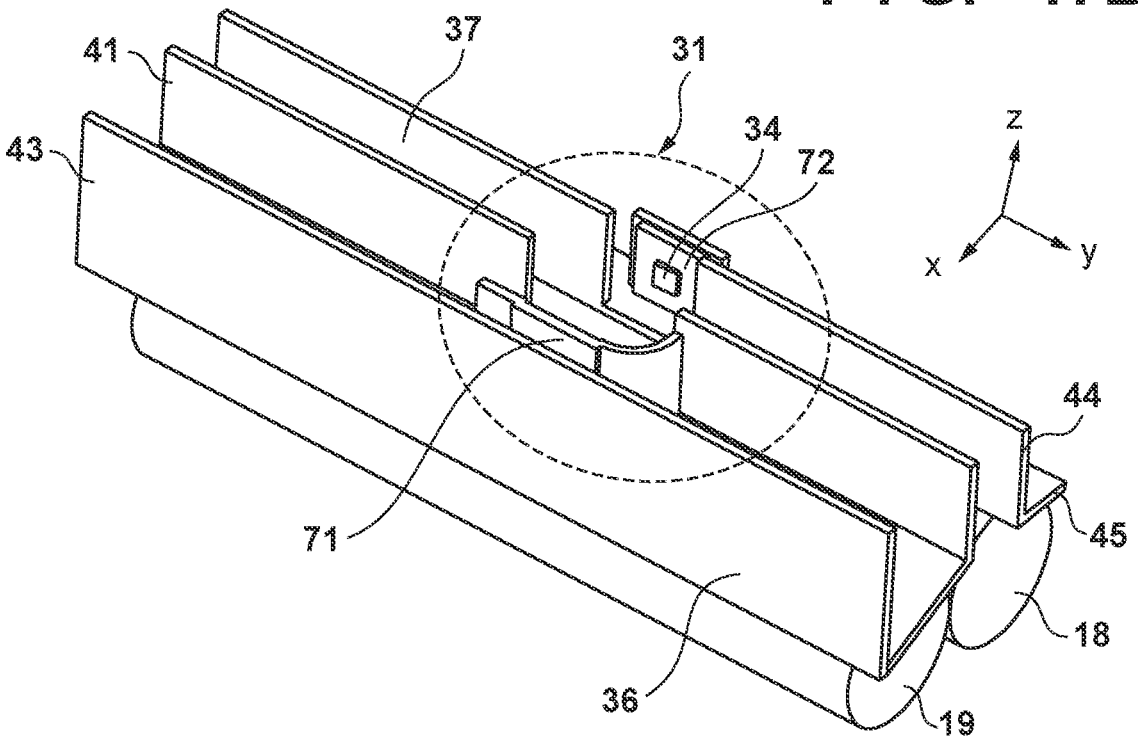

As illustrated by FIG. 17A and FIG. 17B, the sheet sensor 31 of the fifth embodiment is a transmissive type sheet sensor. FIG. 17A and FIG. 17B differ in viewpoints with respect to the sheet sensor 31. The same reference numerals are added to members that are already described. A light-emission substrate 70 that mounts the light emission unit 33 and a light-reception substrate 72 that mounts the light-receiving unit 34 are each arranged to face one another across the conveyance path 49. The light-emission substrate 70 is fixed to a substrate holding member 71 that protrudes upward from the second member 42. The light emission unit 33 emits light so that light crosses a detection position inside the conveyance path 49, from a cutout provided in the center of the first member 41. The light-reception substrate 72 is fixed to a substrate holding member 73 that protrudes upward from the fifth member 45. The light-emission substrate 70 and the light-reception substrate 72 are positioned so that light emitted from the light emission unit 33 passes through the cutout provided in the center of the fourth member 44, and is incident on the light-receiving unit 34.

Figure 18A:
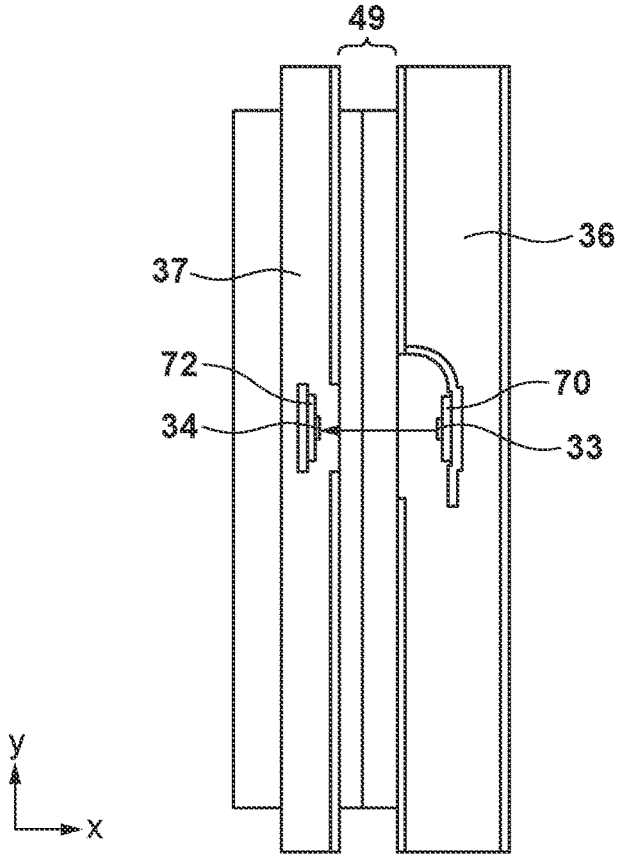
FIGS. 18A and 18B are plan views of the sheet sensor in a fifth embodiment.
Figure 18B:
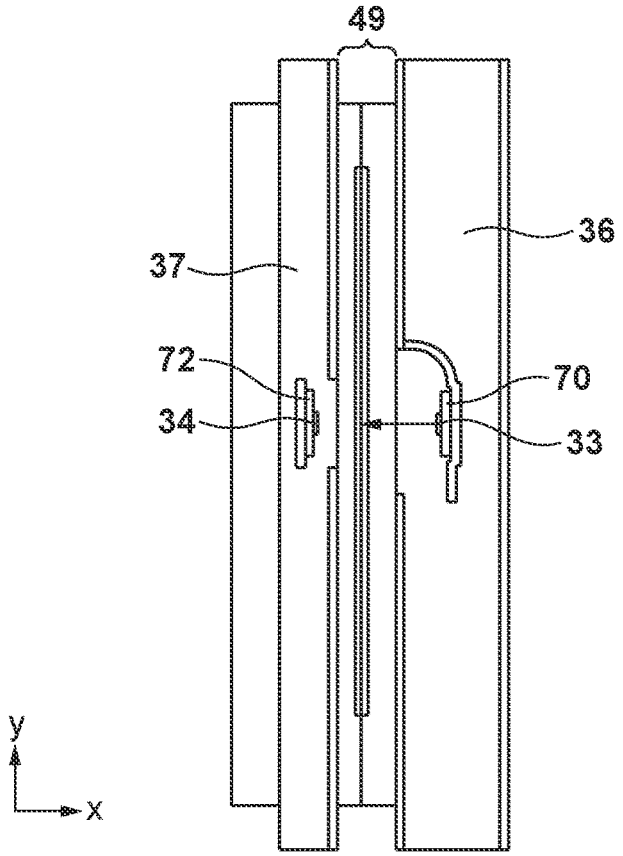

FIG. 18A is a plan view that illustrates the sheet sensor 31 when a sheet P is not passing through a detection position (the conveyance path 49). FIG. 18B is a plan view that illustrates the sheet sensor 31 when a sheet P is passing through a detection position. As illustrated by FIG. 18A, light emitted by the light emission unit 33 crosses the conveyance path 49 and arrives at the light-receiving unit 34. By this, the light-receiving unit 34 outputs a detection signal (for example, a low-level signal) that indicates that a sheet P is not detected. Alternatively, the light-receiving unit 34 does not output a detection signal (for example, a high-level signal) that indicates that a sheet P is detected.

As illustrated by FIG. 18B, when a sheet P is being conveyed on the conveyance path 49, light from the light emission unit 33 arrives at the surface of the sheet P, but this light is light-shielded by the surface of the sheet P. In other words, the light does not arrive at the light-receiving unit 34. Accordingly, the light-receiving unit 34 outputs a detection signal (for example, a high-level signal) that indicates that a sheet P is detected. Alternatively, the light-receiving unit 34 does not output a detection signal (for example, a low-level signal) that indicates that a sheet P is not detected.

Even in the transmissive type sheet sensor employed in the fifth embodiment, light emitted by the light emission unit 33 is diffusely reflected by water vapor generated from a sheet P, and the amount of light received by the light-receiving unit 34 decreases. Therefore, the algorithm for estimating the water vapor amount described in the fourth embodiment can also be applied in the fifth embodiment.

<Curl Correcting Mechanism>

The two rollers that configure the de-curling roller pair 90 are soft rollers made by covering the entirety of metal hard rollers with rubber in a lengthwise direction. The de-curling roller pair 90 are applied to a sheet P so that, when the sheet P passes through the nipping portion of the de-curling roller pair 90, curling of the sheet P is corrected. For example, curling of the sheet P is corrected by using differences in the rotation speed of the two rollers that configure the de-curling roller pair 90. The nipping pressure of the de-curling roller pair 90 can be changed by an actuator controlled by the CPU 26. By this, a curl correcting force is adjusted. The CPU 26 corrects the curl correcting force by controlling the actuator based on printing conditions such as whether there is single-sided printing or double-sided printing.

<Curl Correcting Mechanism Control>

Figure 19:
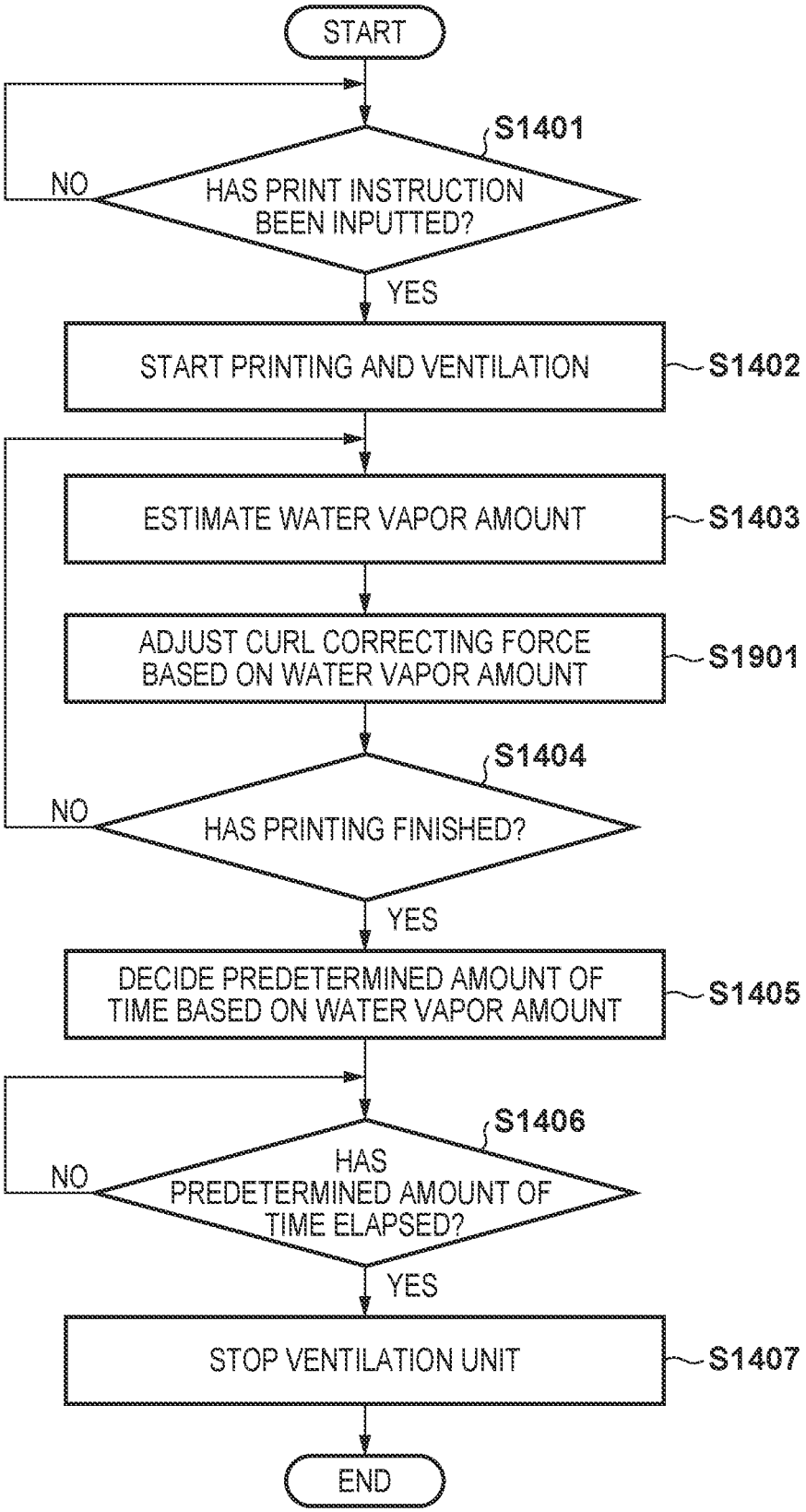
FIG. 19 is a flowchart that illustrates control of a curl correcting mechanism.

FIG. 19 is a flowchart for illustrating control that is executed by the CPU 26. In FIG. 19, a difference with FIG. 14 is that step S1901 is added between step S1403 and step S1404. In step S1901, the CPU 26 adjusts the curl correcting force based on the result of estimating the water vapor amount. For example, when a sheet P having high moisture is conveyed to the fixing apparatus 17, the CPU 26 increases the curl correcting force from a reference value. This is because large curls occur for a sheet P that includes a lot of moisture. In contrast, when a sheet P having low moisture is conveyed to the fixing apparatus 17, the CPU 26 maintains the curl correcting force at the reference value. This is because small curls occur for a sheet P that has low moisture.

By virtue of the fifth embodiment, the CPU 26 can adjust the curl correcting force based on a result of estimating the water vapor amount (the moisture absorption state of a sheet P). By this, it is possible to appropriately correct curling of a sheet P.

<Summary of Fourth and Fifth Embodiments>

The image forming unit 101 and the intermediate transfer unit 102 are examples of an image forming unit for forming a toner image on a hygroscopic sheet. The fixing apparatus 17 is an example of a fixing unit for fixing a toner image formed by an image forming unit to a sheet by applying heat to the toner image. The conveyance path 49 and the double-sided conveyance path 58 are examples of a conveyance path for conveying a sheet that has passed through the fixing unit. The light emission unit 33 is an example of a light-emission unit for emitting and outputting light that crosses the conveyance path. The light emission unit 33 is a light-emission element such as an LED. The light-receiving unit 34 is an example of a light-receiving unit for receiving light that has the light-emission unit as a light source. The light-receiving unit 34 is a light-receiving element such as a phototransistor or a photodiode.

Figure 20:
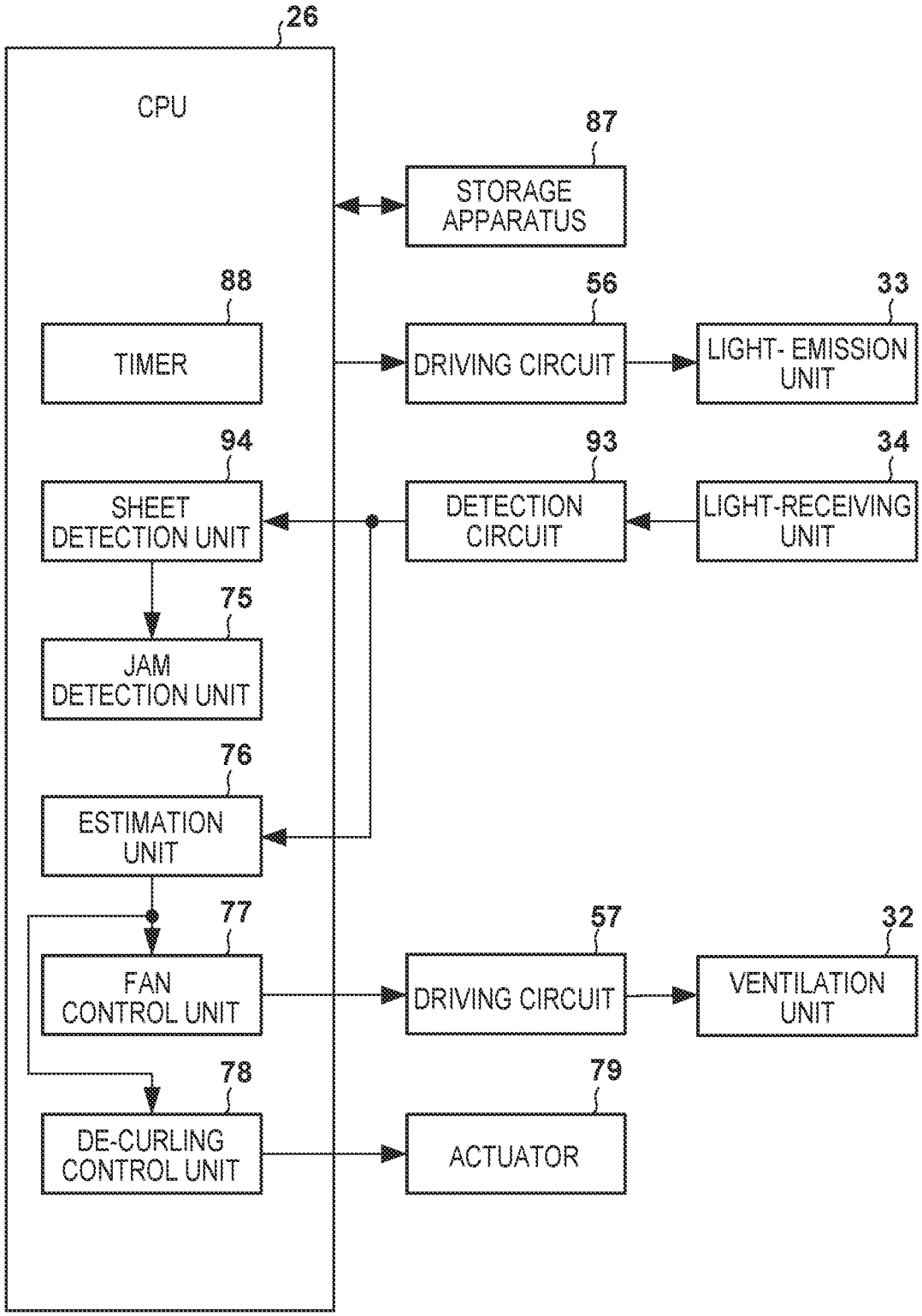
FIG. 20 is a view that illustrates functions of a CPU.
Figure 21:
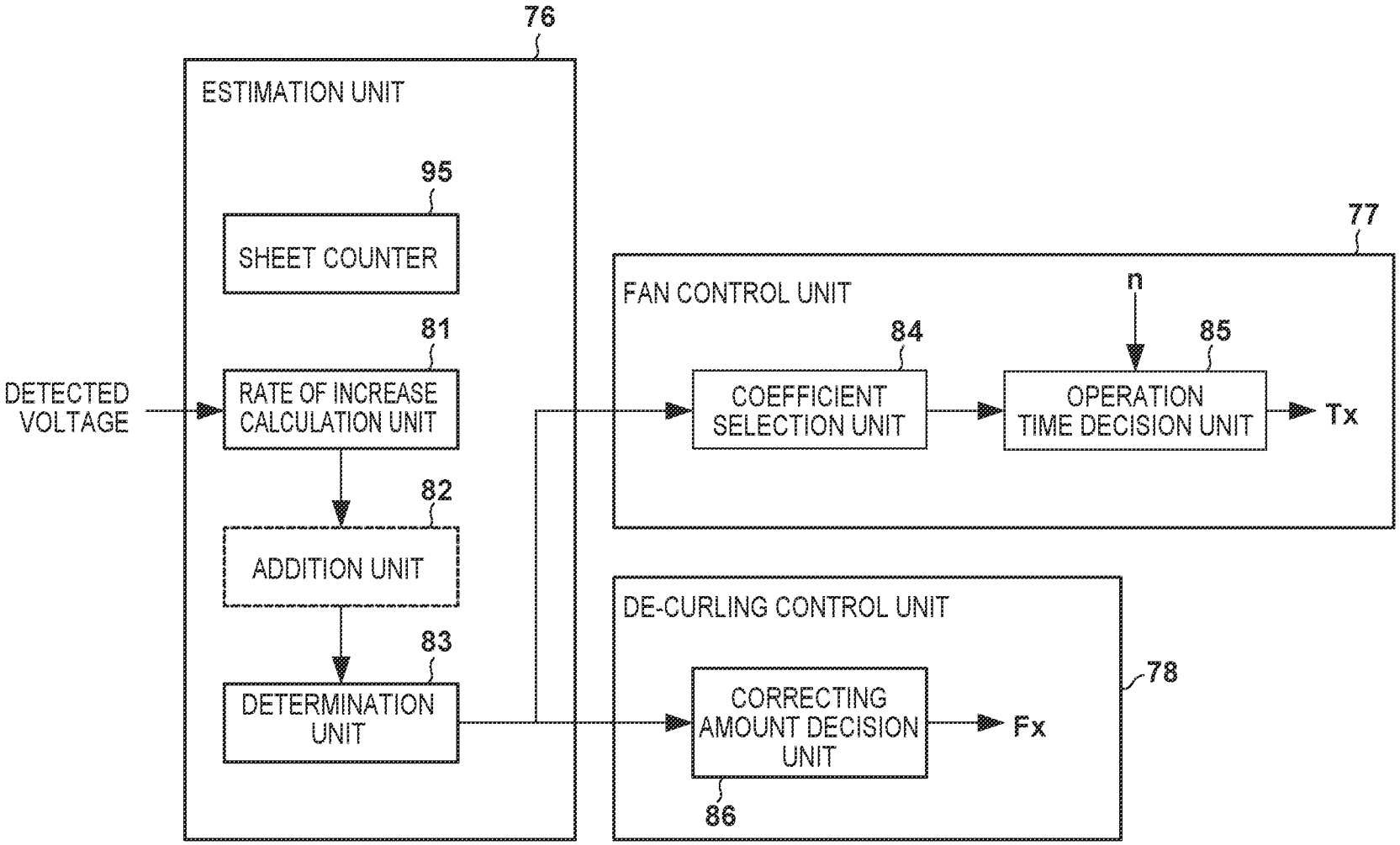
FIG. 21 is a view for describing details of an estimation unit.

FIG. 20 illustrates functions of the CPU 26. FIG. 21 illustrates functions of the estimation unit 76. Some or all of these functions may be realized by the CPU 26 executing a control program, and may be realized by hardware such as an ASIC or an FPGA. ASIC is an abbreviation for application specific integrated circuit. FPGA is an abbreviation for field-programmable gate array. A control program may be stored in the storage apparatus 87.

The sheet detection unit 94 is an example of a sheet detection unit for detecting whether there is a sheet at a position where light crosses a conveyance path, based on a light-reception result by the light-receiving unit. For example, the sheet detection unit 94 detects the existence or absence of a sheet based on a detected voltage outputted by a detection circuit 93. The estimation unit 76 is an example of an estimation unit for estimating a water vapor amount in a conveyance path, based on the light-reception result of the light-receiving unit that is obtained when the sheet detection unit is not detecting a sheet. For example, the estimation unit 76 estimates the water vapor amount based on a detected voltage outputted by the detection circuit 93.

In this way, the light emission unit 33 and the light-receiving unit 34 make combined use of a function for detecting a sheet (sheet sensor) and a function for estimating a water vapor amount (a water vapor amount sensor). Accordingly, the cost-versus-effect of the sheet sensor improves. Note that time when the sheet detection unit is not detecting a sheet is a period from when the trailing edge of an n-th sheet has passed through a detection position until when the leading edge of an (n+1)-th sheet reaches the detection position. This period may be referred to as a sheet interval.

As described in relation to FIG. 12B, the estimation unit 76 may estimate whether the water vapor amount exceeds a water vapor threshold value, in accordance with the amount of light received which is a light-reception result of the light-receiving unit. The amount of light received reduces as the water vapor amount increases, and the amount of light received increases as the water vapor amount reduces. Accordingly, it is possible to estimate the water vapor amount with good accuracy from the amount of light received. The water vapor threshold value is stored in the storage apparatus 87, for example.

As described in relation to FIG. 12A, the light-receiving unit is configured to output a detected voltage that is in an inverse relationship with the amount of light received. The estimation unit 76 may estimate that the water vapor amount exceeds the water vapor threshold value when the detected voltage exceeds a voltage threshold. The estimation unit 76 may estimate that the water vapor amount does not exceed the water vapor threshold value when the detected voltage does not exceed a voltage threshold. In this way, the estimation unit 76 may estimate whether the water vapor amount is high or low.

When a plurality of sheets consecutively pass through the fixing unit, the estimation unit 76 may be configured to estimate the water vapor amount by using detected voltages obtained when second and subsequent sheets have passed through the fixing unit. This is because, as illustrated by FIG. 12B, the detected voltages obtained when the second and subsequent sheets pass through the fixing unit more accurately indicate the water vapor amount. In this way, the estimation unit 76 may ignore a detected voltage obtained when a first sheet passes through the fixing unit.

The estimation unit 76 may be configured to estimate the water vapor amount based on a rate of increase of a detected voltage with respect to an initial voltage. As illustrated by FIG. 21, a rate of increase calculation unit 81 may calculate the rate of increase. As described in relation to FIG. 12B, the initial voltage is a detected voltage that is outputted by the light-receiving unit before a sheet is caused to pass through the fixing unit. The detected voltage is obtained after the sheet passes through the fixing unit.

The rate of increase calculation unit 81 calculates a rate of increase obtained in a period from after an n-th sheet passes through a position until an (n+1)-th sheet passes through the position. The rate of increase calculation unit 81 calculates a rate of increase obtained in a period from after the (n+1)-th sheet passes through the position until an (n+2)-th sheet passes through the position. An addition unit 82 functions as an addition unit for adding these rates of increase. A determination unit 83 may estimate the water vapor amount based on an addition result of the addition unit. For example, the determination unit 83 may determine whether the water vapor amount is high or low by comparing a detected voltage or a rate of increase with a threshold value.

A sheet counter 95 is an example of a counting unit for counting a number of sheets that consecutively pass through the fixing unit. The estimation unit 76 may be configured to estimate the water vapor amount when the number of sheets is a predetermined number. This is because a result of estimating the water vapor amount stabilizes after the number of sheets has reached the predetermined number.

As illustrated by FIG. 17A, the light-emission unit and the light-receiving unit may be arranged to face one another across a conveyance path. As illustrated by FIG. 3A, the reflecting member 38 which is for reflecting light that is outputted by the light-emission unit may also be provided. The light-receiving unit may be arranged to receive light that is reflected by the reflecting member 38.

A jam detection unit 75 illustrated in FIG. 20 is an example of a jam detection unit for detecting a jam of a sheet in the fixing unit, based on a detection result by the sheet detection unit. For example, the jam detection unit 75 determines that a jam of a sheet has occurred in the fixing apparatus 17 when the trailing edge of a sheet cannot be detected even after a predetermined amount of time has passed from a timing when the jam detection unit 75 detected the leading edge of the sheet. A sheet detection result from the sheet detection unit 94 may be used to decide a timing for switching the conveyance direction of the sheet in the double-sided conveyance path 58.

As illustrated by FIG. 13, the ventilation unit 32 is an example of a ventilation unit for sending air to a conveyance guide member that forms a conveyance path. A fan control unit 77 illustrated in FIG. 20 is an example of a control unit for controlling at least one of an airflow rate and an operation duration of the ventilation unit, in accordance with a water vapor amount. A method for deciding the operation duration may be as exemplified using step S1405 or FIG. 15.

The conveyance guide member 59 may be a part of the double-sided conveyance path 58 which is for reversing an image formation side of a sheet from a first surface on which a toner image has been formed to a second surface in order to form a toner image on the second surface of the sheet. The conveyance guide member 59 may be a reversing and conveying path for reversing an image formation side of a sheet from a first surface on which a toner image has been formed to a second surface in order to form a toner image on the second surface of the sheet. The reversing rollers 27 are an example of a reversing roller provided on the reversing and conveying path. The opening 60 is an example of an opening provided on the reversing and conveying path and communicates with the outside of an image forming apparatus. The ventilation unit 32 is arranged so that air sent by the ventilation unit is discharged outside of the image forming apparatus from the opening. By this, it is possible to discharge water vapor that occurs inside the image forming apparatus 100 to outside of the image forming apparatus 100.

The fan control unit 77 controls the ventilation unit 32 through the driving circuit 57. The fan control unit 77 may start a timer 88 when a print job ends. The fan control unit 77 stops the ventilation unit 32 when an elapsed amount of time becomes an operation duration Tx. In addition, the fan control unit 77 may decide at least one of the operation duration and the airflow rate of the ventilation unit, in accordance with a water vapor amount and a number of sheets that consecutively pass through the fixing unit. A coefficient selection unit 84 may select a coefficient such as an angle in accordance with the water vapor amount. As illustrated by FIG. 15, selection of a coefficient can correspond to selection of an equation for a straight line for deciding the predetermined amount of time Tx. An operation time decision unit 85 may decide the predetermined amount of time Tx based on a number of sheets n obtained by the sheet counter 95, and the selected coefficient. By this, the operation duration of the ventilation unit 32 should be appropriately controlled. The operation duration Tx as illustrated by FIG. 6 may be the amount of time from after a print job with respect to a plurality of sheets ends until the ventilation unit is stopped. Because water vapor ordinarily occurs from a sheet during performance of a print job, the ventilation unit 32 discharges the water vapor outside of the image forming apparatus 100. There are cases where, when a print job finishes, water vapor has not been sufficiently discharged. Accordingly, the ventilation unit 32 may operate after the print job has finished. However, when the ventilation unit 32 is operating even after water vapor has been sufficiently discharged, power is consumed wastefully. Therefore, the operation duration Tx is decided in accordance with an amount of water vapor that has occurred.

The de-curling roller pair 90 is an example of a curl correcting unit for correcting a curl that occurs in a sheet by passing through a fixing unit. A de-curling control unit 78 may adjust a curl correcting amount Fx of the de-curling roller pair 90 by controlling an actuator 79 in accordance with water vapor amount. Note that a correcting amount decision unit 86 decides a curl correcting amount by the curl correcting unit in accordance with the water vapor amount.

Note that a reflective type sheet sensor is used in the fourth embodiment, but the transmissive type sheet sensor described in the fifth embodiment may be used instead of the reflective type sheet sensor. In addition, a transmissive type sheet sensor is used in the fifth embodiment, but the reflective type sheet sensor described in the fourth embodiment may be used instead of the transmissive type sheet sensor.

Other Embodiments

Embodiment(s) of the present invention can also be realized by a computer of a system or apparatus that reads out and executes computer executable instructions (e.g., one or more programs) recorded on a storage medium (which may also be referred to more fully as 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-215023, filed Nov. 7, 2017, No. 2018-085722, filed Apr. 26, 2018, and No. 2018-201162, filed Oct. 25, 2018, which are hereby incorporated by reference herein in their entirety.

What is claimed is:

1. An image forming apparatus comprising:

a light-emission unit configured to emit light;

a reflecting member that reflects the light emitted from the light-emission unit;

a light-receiving unit configured to receive the light reflected from the reflecting member, the light crossing a conveyance path, on which a sheet is conveyed, one or more times from the light-emission unit until reaching the light-receiving unit;

a detection unit configured to detect, based on a detection signal that the light-receiving unit outputs in accordance with an amount of light received, whether a sheet is at a position where light crosses the conveyance path, during a time period when the sheet may arrive at the position;

a ventilation unit configured to send air, the air being sent to the reflecting member; and a control unit configured to adjust at least one of an operation duration and an airflow rate of the ventilation unit, in accordance with the detection signal outputted by the light-receiving unit during a time period when the sheet has not arrived at the position.

2. The image forming apparatus according to claim 1, wherein the control unit is configured to:

when a level of the detection signal does not exceed a dew condensation threshold value, increase the airflow rate of the ventilation unit or continue ventilation by the ventilation unit, and when a level of the detection signal exceeds a dew condensation threshold value, reduce the airflow rate of the ventilation unit or stop ventilation by the ventilation unit.

3. The image forming apparatus according to claim 1, further comprising:

a measurement unit configured to measure the operation duration of the ventilation unit, wherein, when the level of the detection signal does not exceed a dew condensation threshold value but the operation duration measured by the measurement unit is greater than or equal to a predetermined amount of time, the control unit reduces the airflow rate of the ventilation unit or stops ventilation by the ventilation unit.

4. The image forming apparatus according to claim 1, wherein the control unit causes the ventilation unit to operate while the image forming apparatus is forming an image on a sheet, and, when the image forming apparatus finishes forming the image on the sheet, adjusts at least one of the airflow rate and the operation duration of the ventilation unit in accordance with the detection signal outputted by the light-receiving unit when there is no sheet at the position where light crosses in the conveyance path.

5. The image forming apparatus according to claim 1, wherein when power is supplied from a power supply and the image forming apparatus is activated or when the image forming apparatus returns from a state where image formation is not performed to a state where image formation can be performed, the control unit causes the light-emission unit to output light, and drives or stops the ventilation unit, in accordance with the detection signal outputted by the light-receiving unit.

6. The image forming apparatus according to claim 5, wherein the control unit is configured to:

when a level of the detection signal does not exceed a dew condensation threshold value, start ventilation by the ventilation unit or increase the airflow rate of the ventilation unit, and when a level of the detection signal exceeds a dew condensation threshold value, reduce the airflow rate of the ventilation unit or not perform ventilation by the ventilation unit.

7. The image forming apparatus according to claim 1, wherein when power is supplied from a power supply and the image forming apparatus is activated or when the image forming apparatus returns from a state where image formation is not performed to a state where image formation can be performed, the control unit causes the light-emission unit to output light, causes the ventilation unit to start ventilation, and, in accordance with the detection signal outputted by the light-receiving unit stops the ventilation unit, or adjusts the amount of light emitted by the light-emission unit or a gain of the light-receiving unit.

8. The image forming apparatus according to claim 7, wherein the control unit is configured to:

continue ventilation by the ventilation unit when a level of the detection signal is not greater than or equal to a lower limit value of a predetermined range, and when a level of the detection signal is greater than or equal to the lower limit value of the predetermined range, reduce the airflow rate of the ventilation unit or stop ventilation by the ventilation unit.

9. The image forming apparatus according to claim 8, further comprising:

a measurement unit configured to measure the operation duration of the ventilation unit, wherein, in a case in which the level of the detection signal is not greater than or equal to the lower limit value of the predetermined range and the operation duration measured by the measurement unit is greater than or equal to a predetermined amount of time, the control unit increases the amount of light emitted by the light-emission unit or increases the gain of the light-receiving unit.

10. The image forming apparatus according to claim 9, wherein the control unit increases the gain of the light-receiving unit if the level of the detection signal is not greater than or equal to the lower limit value of the predetermined range, even if the amount of light emitted by the light-emission unit is increased to a maximum value that can be set.

11. The image forming apparatus according to claim 9, wherein the control unit increases the amount of light emitted by the light-emission unit in a case in which the level of the detection signal is not greater than or equal to the lower limit value of the predetermined range, even if the gain of the light-receiving unit is increased to a maximum value that can be set.

12. The image forming apparatus according to claim 9, further comprising:

a storage unit configured to store, as an initial value, an amount of illumination light by the light-emission unit when the level of the detection signal is within the predetermined range, wherein the control unit sets the light-emission unit to the initial value stored in the storage unit when starting light emission by the light-emission unit.

13. The image forming apparatus according to claim 9, further comprising:

a storage unit configured to store, as an initial value, a gain of the light-receiving unit when the level of the detection signal is within the predetermined range, wherein the control unit sets the light-receiving unit to the initial value stored in the storage unit when starting reception of light by the light-receiving unit.

14. The image forming apparatus according to claim 1, further comprising:

a ventilation duct that guides air that is blown out from the ventilation unit or sucked in by the ventilation unit to the reflecting member so that the reflecting member is ventilated with the air.

15. The image forming apparatus according to claim 1, further comprising:

a first guide member and a second guide member that guide a sheet and are provided facing each other in the conveyance path, wherein the light-emission unit and the light-receiving unit are fixed to the first guide member, and the reflecting member is fixed to the second guide member.

16. The image forming apparatus according to claim 1, further comprising:

a light-shielding member provided between the light-emission unit and the light-receiving unit.

17. The image forming apparatus according to claim 1, further comprising:

a conveyance guide member that forms the conveyance path, wherein the ventilation unit sends air to each of the reflecting member and the conveyance guide member.

18. The image forming apparatus according to claim 17, wherein the conveyance path is a reversing and conveying path for reversing an image formation side of a sheet from a first surface on which an image has been formed to a second surface in order to form an image on the second surface of the sheet.

19. The image forming apparatus according to claim 18, further comprising:

a reversing roller provided in the reversing and conveying path; and an opening that is provided in the reversing and conveying path and communicates with outside of the image forming apparatus, wherein the ventilation unit is arranged so that air ventilated by the ventilation unit is discharged outside of the image forming apparatus from the opening.

20. An image forming apparatus comprising:

a light-emission unit configured to emit light;

a reflecting member that reflects the light emitted from the light-emission unit;

a light-receiving unit configured to receive the light reflected from the reflecting member, the light crossing a conveyance path, on which a sheet is conveyed, one or more times from the light-emission unit until reaching the light-receiving unit;

a detection unit configured to detect, based on a detection signal that the light-receiving unit outputs in accordance with an amount of light received, whether a sheet is at a position where light crosses the conveyance path, during a time period when the sheet is conveyed;

a ventilation unit configured to send air, the air being sent to the reflecting member; and a control unit configured to adjust at least one of an operation duration and an airflow rate of the ventilation unit, in accordance with the detection signal outputted by the light-receiving unit during a time period when the sheet is not conveyed.

* * * * *